US007261587B2

(12) United States Patent
Nakamura

(10) Patent No.: US 7,261,587 B2
(45) Date of Patent: Aug. 28, 2007

(54) CONNECTOR AND A METHOD OF ASSEMBLING IT

(75) Inventor: Hideto Nakamura, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 11/387,318

(22) Filed: Mar. 23, 2006

(65) Prior Publication Data

US 2006/0216984 A1 Sep. 28, 2006

(30) Foreign Application Priority Data

Mar. 23, 2005 (JP) ..... 2005-084151

(51) Int. Cl.
*H01R 3/00* (2006.01)

(52) U.S. Cl. ..... 439/488

(58) Field of Classification Search ..... 439/488, 439/489, 352, 188, 18
See application file for complete search history.

(56) References Cited

U.S. PATENT DOCUMENTS 6,276,957 B1 8/2001 Seko et al.
6,341,972 B1 1/2002 Odorfer
6,439,914 B2 8/2002 Nimura
6,743,051 B2 * 6/2004 Hayashi ..... 439/620.05

FOREIGN PATENT DOCUMENTS

JP 2003-45554 2/2003

* cited by examiner

*Primary Examiner*—Alexander Gilman
(74) *Attorney, Agent, or Firm*—Gerald E. Hespos; Anthony J. Casella

(57) ABSTRACT

Terminal fittings (21A, 21B) are inserted into cavities (45) of a housing (40) from behind and are partly locked by metal locks (28). A cover (70) is mounted on the rear surface of the housing (40), and a detector (100) is insertable through the rear surface of the mounted cover (70) for detecting whether the housing (40) and a mating housing (11) are connected properly. The cover (70) has an opening (87) for exposing the terminal fittings (21A, 21B), and the detector (100) has a pushing portion (110) insertable through the opening (87). The pushing portion (110) pushes any insufficiently inserted terminal fittings (21A, 21B) to proper insertion positions as the detector (100) is inserted to a full locking position.

14 Claims, 24 Drawing Sheets

CONNECTOR AND A METHOD OF ASSEMBLING IT

BACKGROUND OF THE INVENTION

1. Field of the Invention

The present invention relates to a connector fitted with a cover and to a method of assembling it.

2. Description of the Related Art

Japanese Unexamined Patent Publication No. 2003-45554 discloses a connector with a housing that has a rear surface. A cover is mounted on the rear surface of the housing and is locked in place by a locking mechanism. The cover functions to hold a group of wires drawn out from the housing and to protect drawn-out portions of the wires.

Some covers of this type are intended to guarantee proper insertion of terminal fittings and to eliminate a need for a separate retainer. However, there is a possibility of leaving the terminal fittings insufficiently inserted even if the prior art cover is mounted properly. Thus, there has been a demand for a cover with an enhanced ability to guarantee proper insertion of terminal fittings.

The present invention was developed in view of the above problem and an object thereof is to guarantee the insertion of terminal fittings to proper positions.

SUMMARY OF THE INVENTION

The invention relates to a connector with a housing and terminal fittings that are insertable into the housing in an inserting direction. A cover is mountable to the housing and at least partly covers a surface of the housing. The cover has an opening that exposes portions of the terminal fittings in the housing when the cover is mounted properly on the housing. A detector is mountable to the cover and has at least one pushing portion that can push the portions of the terminal fittings exposed at the opening of the cover. Thus, the detector can push the terminal fittings to proper insertion positions when the detector is mounted properly on the properly mounted cover.

The cover preferably is mountable to cover the rear surface of the housing, and the detector preferably is mountable from behind the cover. The opening of the cover preferably exposes rear ends of the terminal fittings when the cover is mounted properly on the housing.

The connector may further comprise a resiliently deformable housing lock for locking the housing and a mating housing in a properly connected state. Additionally, the detector preferably includes a housing detecting piece that is insertable into a deformation space for the housing lock.

The housing lock remains deformed and in the deformation space when the housings are only partly connected. Therefore, the housing detecting piece of the detector contacts the deformed housing lock and hinders insertion of the detector. Thus, partial connection of the two housings can be detected. On the other hand, the pushing portion enters the opening of the cover and contacts the rear end of any insufficiently inserted terminal fitting if the housings are connected properly. The detector then pushes any insufficiently inserted terminal fitting to the proper insertion position as the detector is mounted. Accordingly, the detector performs two functions, namely, pushing the terminal fittings to proper insertion positions and detecting the connected state of the two housings. As a result, the construction of the connector can be simpler.

The detector preferably includes a holder that is engageable with the housing to hold the detector in a properly mounted position relative to both the housing and the cover. Thus, the terminal fittings can be more securely retained.

The housing preferably includes a resiliently deformable cover lock for locking the cover on the housing. Additionally, the detector preferably includes a cover detecting piece that is insertable into a deformation space for the cover lock as the detector is mounted.

The cover lock remains deformed and in the deformation space unless the cover is mounted properly on the housing. Thus, the cover detecting piece contacts the cover lock to hinder insertion of the detector. Accordingly, the partly mounted state of the cover can be detected.

The detector performs two functions, namely, detecting the connected state of the housings and pushing the terminal fittings to the proper insertion positions. Therefore, the construction of the connector can be simpler.

The deformation spaces for the cover lock and the housing lock preferably are formed on substantially the same path and communicate with each other. Additionally, the detector preferably includes a detecting piece that is insertable into both deformation spaces and that functions as both the cover detecting piece and the housing detecting piece. Accordingly, the construction of the detector can be simpler and a mounting space for the detector can be smaller.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

A connector in accordance with the invention is identified by the numeral 20 in the above-described figures and is intended for an inflator, such as a built-in inflator of an airbag device. The connector is connectable with a mating connector 10. Mating ends of the connector 20 and the mating connector 10 are referred to herein as the front ends. Additionally, the terms upper and lower are used herein for a convenient frame of reference based on the orientation shown in the figures. However, these terms are not intended to imply a required gravitational orientation for the connector 20.

Figure 19:
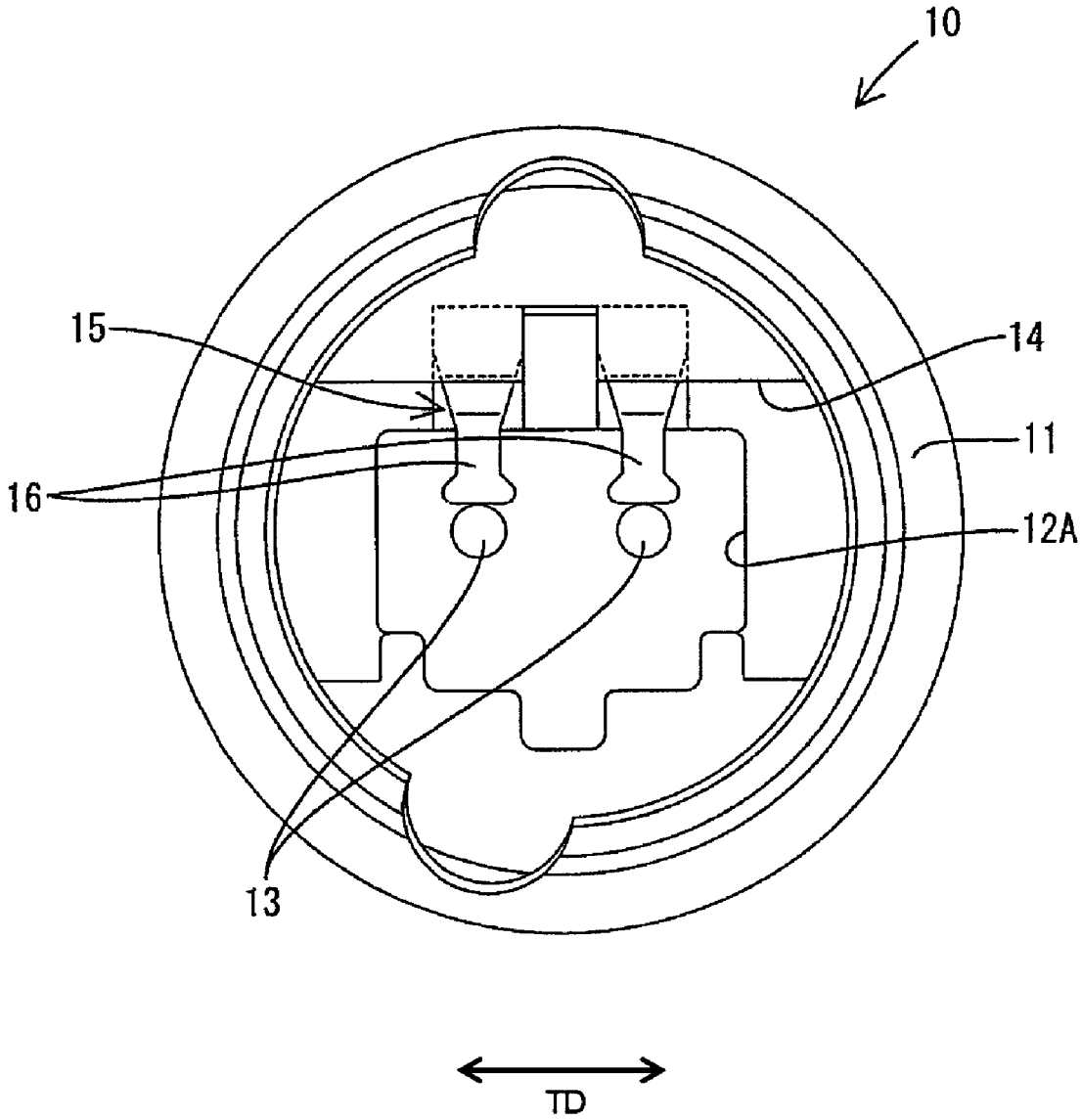
FIG. 19 is a front view of a mating connector.

The mating connector 10 has a thick-walled tubular housing 11 that projects integrally from a wall of the airbag device, as shown in FIGS. 19 and 22. A guide 12 is mounted integrally inside the housing 11 and is formed with a guiding hole 12A for receiving a portion of the connector 20. Two terminal pins 13 project substantially side by side from the back surface of the guiding hole 12A in the housing 11 and are spaced apart along a transverse direction TD. The terminal pins 13 are to be connected with the inflator or the inflator circuit.

The upper surface of the guiding hole 12A is elevated slightly to form a mounting surface 14 for a shorting terminal 15. The shorting terminal 15 has two contact pieces 16 formed at substantially the same spacing as the terminal pins 13. A portion of the shorting terminal 15 adjacent the base ends of the contact pieces 16 is embedded near the front end of the mounting surface 14. The two contact pieces 16 extend back from the embedded portion of the shorting terminal 15 at positions slightly below the mounting surface 14. However, each contact piece 16 has a slanted portion 16A that slopes down and away from the mounting surface 14 so that an intermediate part of each contact piece 16 is spaced farther below the mounting surface 14. Extending ends 16B of the contact pieces 16 are bent down at a substantially right angle (see FIG. 22(A)) and resiliently touch the base ends of the corresponding terminal pins 13 from above. Thus, the terminal pins 13 are shorted with each other in a normal position of the shorting terminal 15.

Figure 22A:
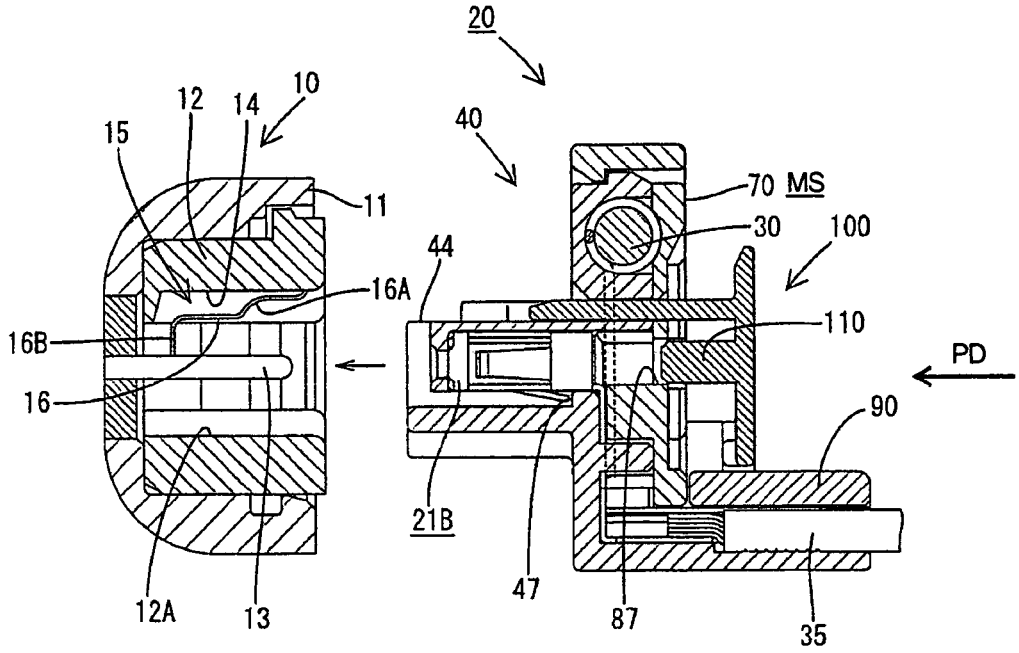
FIGS. 22(A) and 22(B) are a vertical section and a horizontal section showing a state before the connector is connected with the mating connector.
Figure 22B:
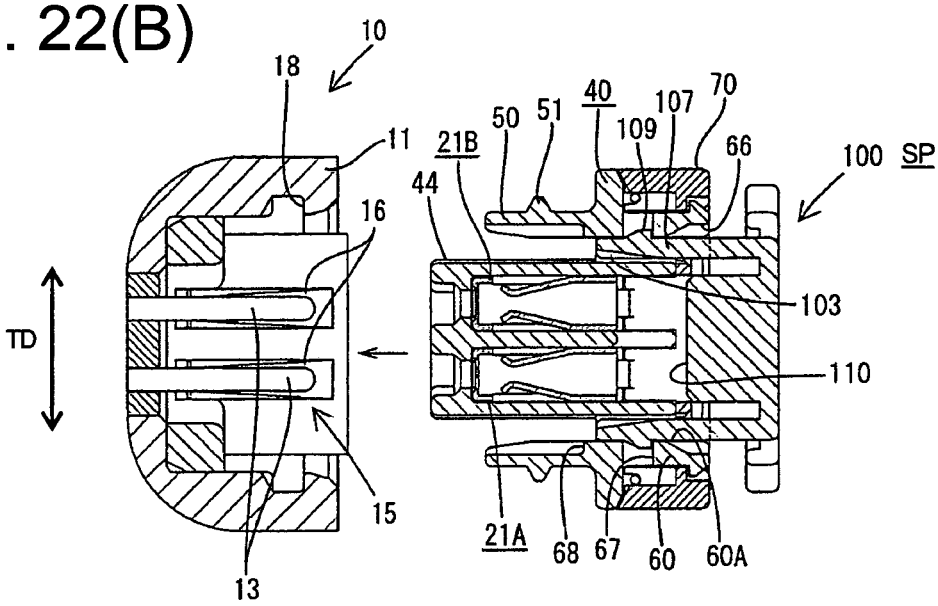

Front parts of the side walls of the guiding hole 12A are cut off and locking grooves 18 are formed along a peripheral direction in the left and right inner surfaces of the housing 11 at positions retracted a specified distance form the front edge, as shown in FIG. 22(B).

Figure 1:
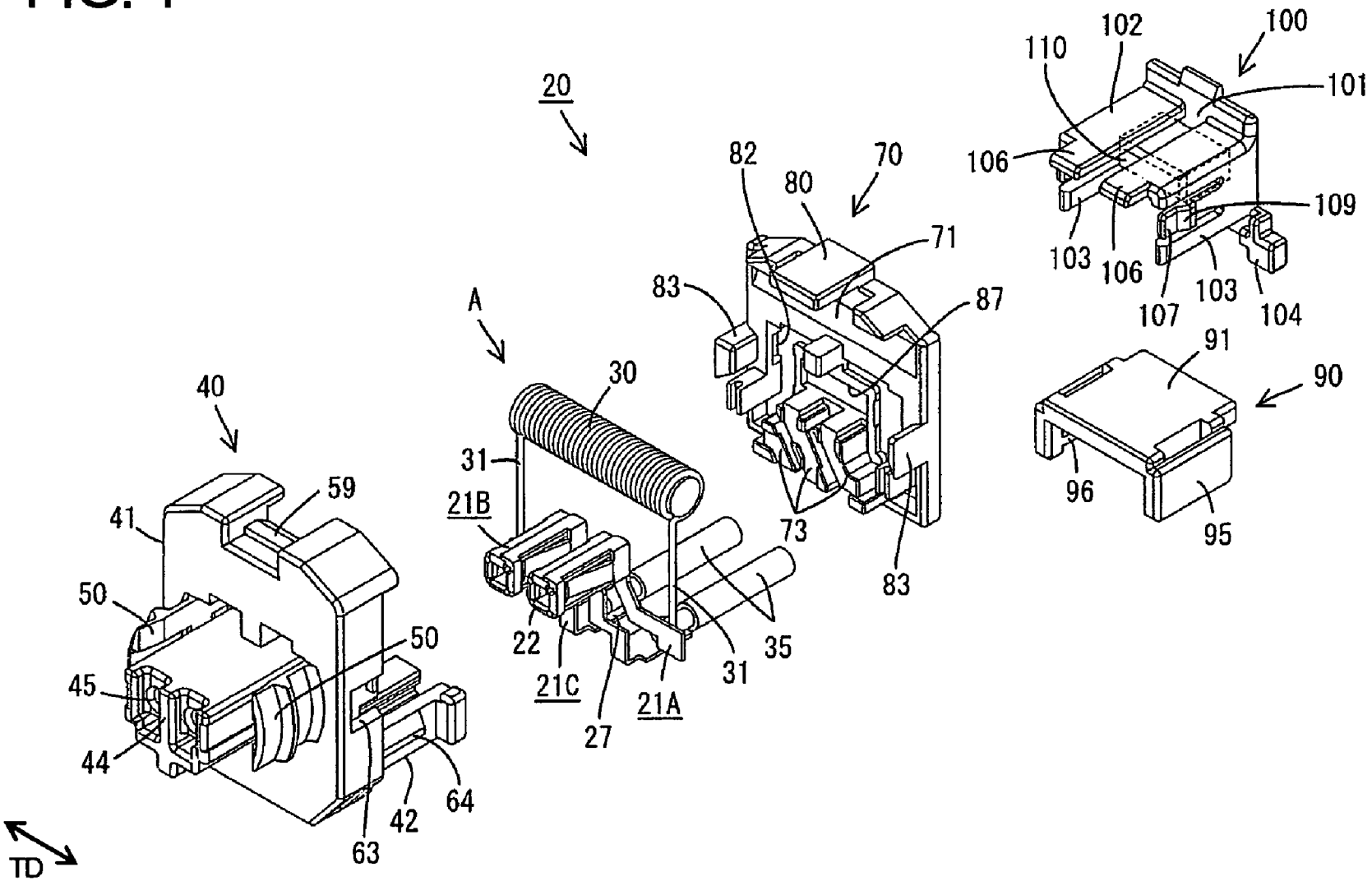
FIG. 1 is an exploded perspective view of a connector according to one embodiment of the invention.

The connector 20 is a straight type connector in which the orientation of terminal fittings and a wire draw-out direction are substantially opposite. As shown in FIG. 1, the connector 20 has a housing 40 and first to third terminal fittings 21A to 21C and a coil 30 are mounted in the housing 40. First and second covers 70, 90 are mounted on the rear surface of the housing 40, and a detector 100 is provided for detecting whether the housing 40 and the housing 11 of the mating connector 10 have been connected properly.

The coil 30 functions to remove noise, and two substantially parallel lead wires 31 extend in the same direction from the opposite ends of the coil 30.

The terminal fittings 21 are formed by press-working a conductive metal plate having good electrical conduction, such as a copper alloy.

Figure 5:
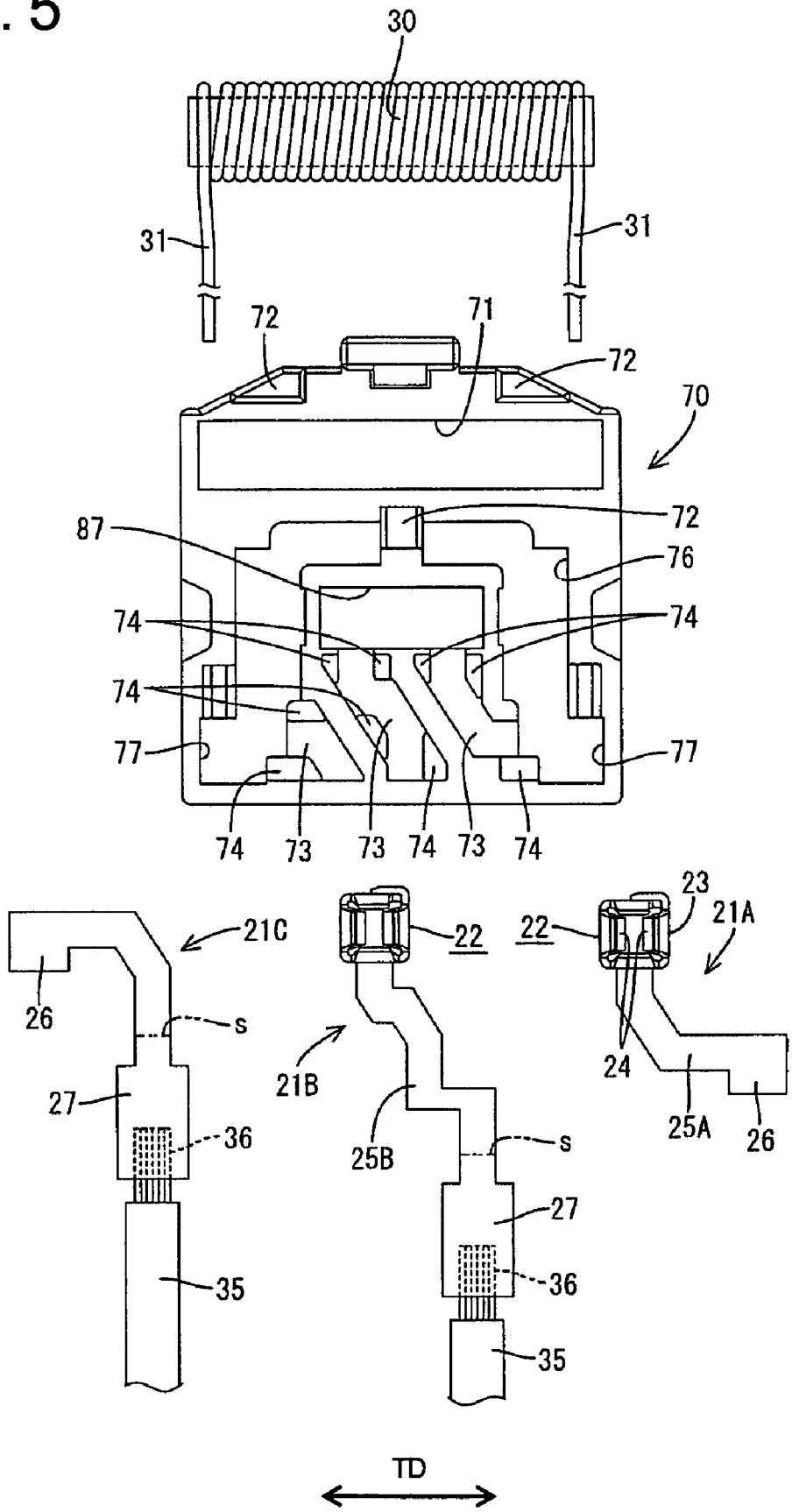
FIG. 5 is a view showing an assembling operation.
Figure 6:
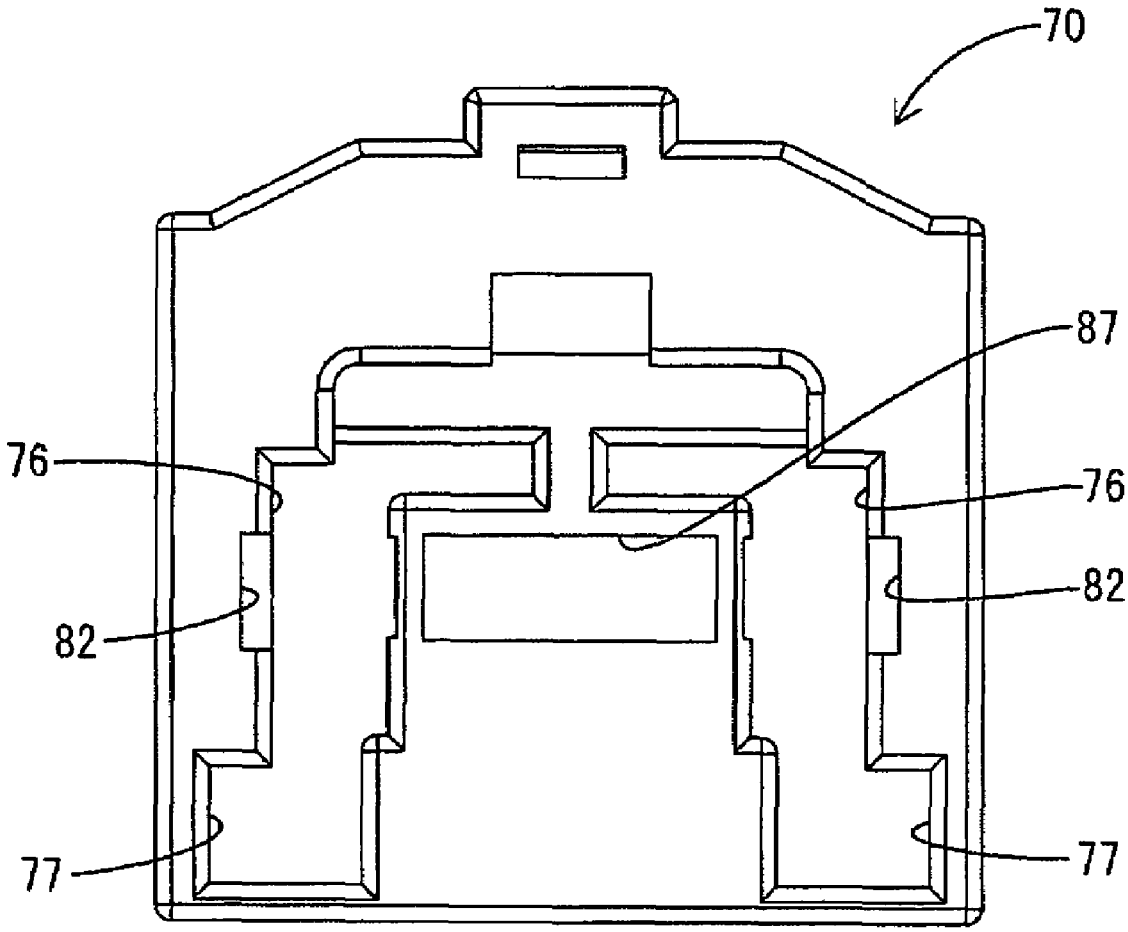
FIG. 6 is a front view of a first cover.

As shown in FIG. 5, the first terminal fitting 21A has a female connecting portion 22 with a rectangular tube 23. Two inwardly projecting contact pieces 24 are formed by embossing or cutting and bending the left and right surfaces of the rectangular tube 23. Thus, the terminal pin 13 can be inserted into the female connecting portion 22 from the front for resilient connection with both contact pieces 24. A metal lock 28 is formed at the bottom of the female connecting portion 22 by cutting and bending (see FIG. 14).

A lead 25A is provided at the rear end of a female connecting portion 22 of the first terminal 21A. The lead 25A is in the form of a busbar and is bent down substantially at a right angle from the rear edge of the bottom plate of the female connecting portion 22. When viewed from the front, as shown in FIG. 5, the lead 25A extends down a short distance, then extends obliquely down and to the right and then extends laterally to the right. A widened coil welding portion 26 is formed at the bottom of the lead 25A for welding to one lead wire 31 of the coil 30.

The second terminal fitting 21B also has a female connecting portion 22 and a lead 25B in the form of a busbar is bent down substantially at a right angle from the rear end of the female connecting portion 22. When viewed from the front, the lead 25B extends down and laterally to right twice to define a crank shape. The first corner of the lead 25B has an oblique posture substantially parallel with an oblique portion of the lead 25A of the first terminal fitting 21A. A wide wire welding portion 27 is formed at the bottom end of lead 25B for welded connection to a core 36 of one wire 35.

The second terminal fitting 21B is bent at a substantially right angle along a bending line "s" near the wire welding portion 27 of the lead 21B.

The third terminal fitting 21C is a busbar cut or stamped into a substantially L shape with a horizontal leg that extends to the left and a vertical leg that extends down when viewed from the front, as shown in FIG. 5. A corner of the third terminal fitting 21C between the two legs has an oblique posture substantially parallel with the oblique portions of the leads 25A, 25B. A wide coil welding portion 26 extends down from the left end of the horizontal leg of the third terminal fitting 21C for welded connection to the other lead wire 31 of the coil 30. A wide wire welding portion 27 extends down from the vertical leg for welded connection to a core 36 of the other wire 35. The third terminal fitting 21C is bent substantially at right angle along a bending line "s" at a position near the wire welding portion 27.

Figure 3:
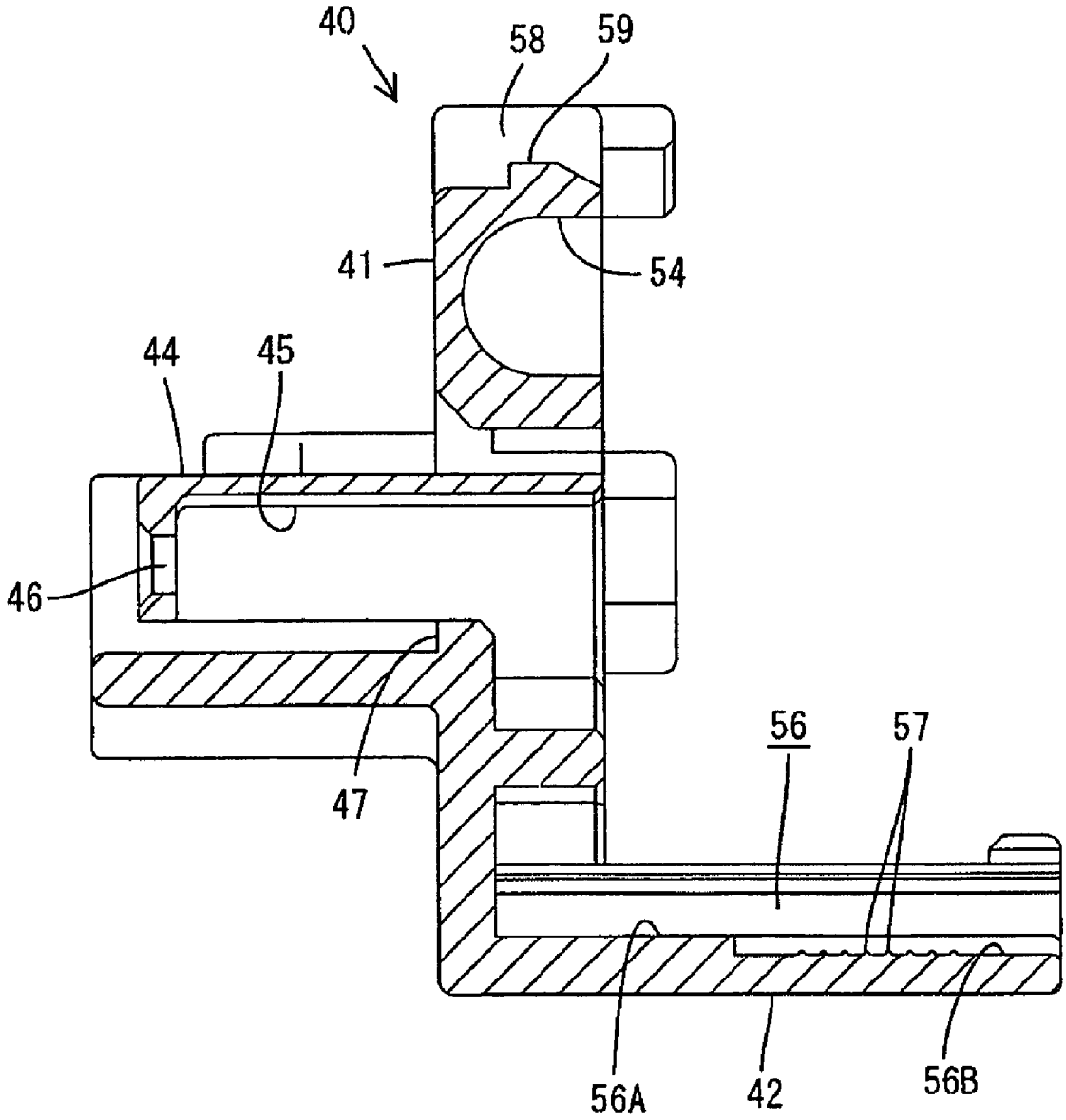
FIG. 3 is a vertical section of the housing.

The housing 40 is made e.g. of a synthetic resin such as PBT (polybutylene terephthalate) and has a terminal accommodating portion 41 and a wire accommodating portion 42 aligned substantially at right angles. Thus, the housing 40 has a substantially L-shape, as shown in FIG. 3. A tower 44 projects forward from a substantially middle position on the front surface of the terminal accommodating portion 41 with respect to the height direction, and is configured to fit into the guiding hole 12A of the mating connector 10. Two side-by-side cavities 45 are formed in the tower 44 and are spaced apart along the transverse direction TD at the substantially same spacing as the terminal pins 13. The female connecting portions 22 of the first and second terminal fittings 21A, 21B can be inserted into the cavities 45 from behind.

A terminal insertion opening 46 is formed in the front wall of each cavity 45 and is configured for receiving the mating terminal pin 13. An engaging portion 47 is formed in the bottom surface of the cavity 45 and is engageable with the metal lock 28 when the female connecting portion 22 is inserted into the respective cavity 45 to a proper position.

An insertion path 49 extends along forward and backward directions at the left and right sides the tower 44 and parts of the top of the tower 44 near the left and right sides. The insertion path 49 is configured for receiving the detector 10. Housing locks 50 project forward from the front surface of the terminal accommodating portion 41 at the outer sides of the left and right parts of the insertion path 49. The housing locks 50 are configured for locking the housing 40 and the housing 11 of the mating connector 10 together. The housing locks 50 have arcuate outer surfaces configured for insertion substantially along the inner surface of the mating housing 11. Elongated locking projections 51 of substantially triangular cross section are formed on the arcuate outer surfaces and are fittable into the locking grooves 18 of the mating housing 11. Front sides of the housing locks 50 are resiliently deformable inwardly towards the insertion path 49.

Figure 2:
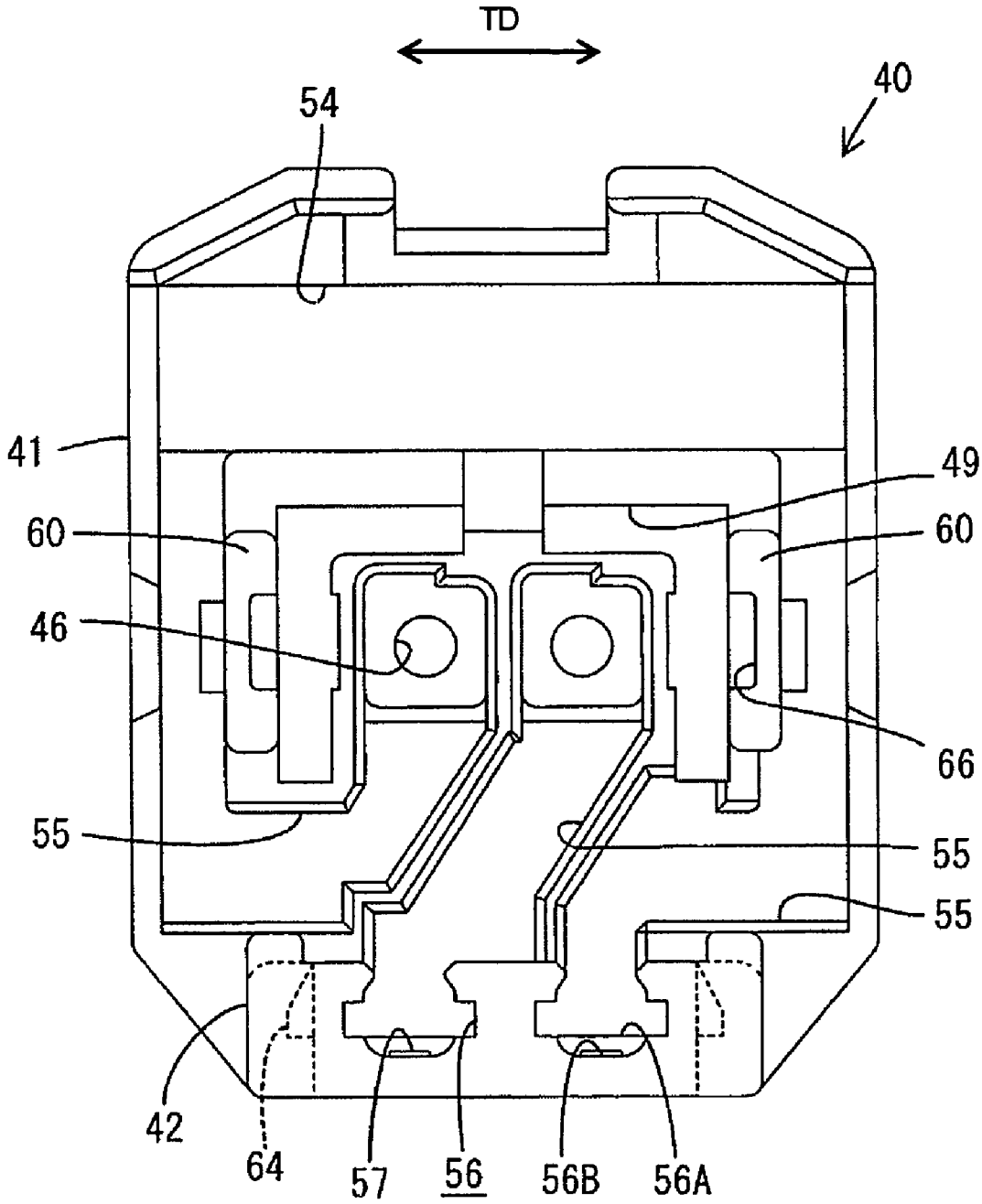
FIG. 2 is a rear view of a housing.

As shown in FIGS. 2 and 3, a coil accommodating recess 54 is formed along the upper edge of the rear surface of the terminal accommodating portion 41 for receiving the coil 30, and terminal accommodating grooves 55 are formed in a lower part of the rear surface of the terminal accommodating portion 41 for accommodating the leads 25A, 25B of the first and second terminal fittings 21A, 21B and the third terminal fitting 21C.

Figure 4:
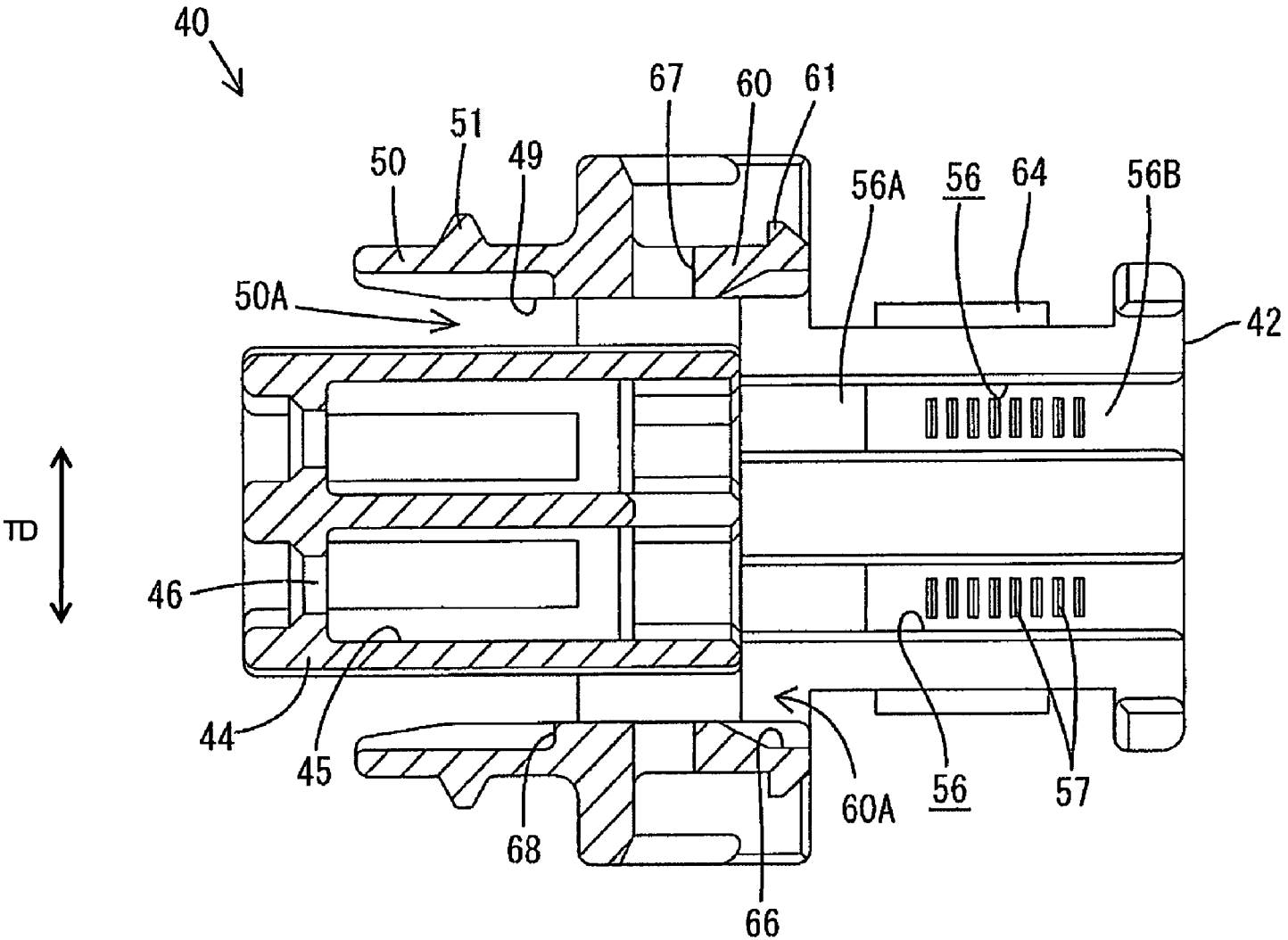
FIG. 4 is a horizontal section of the housing.
Figure 17:
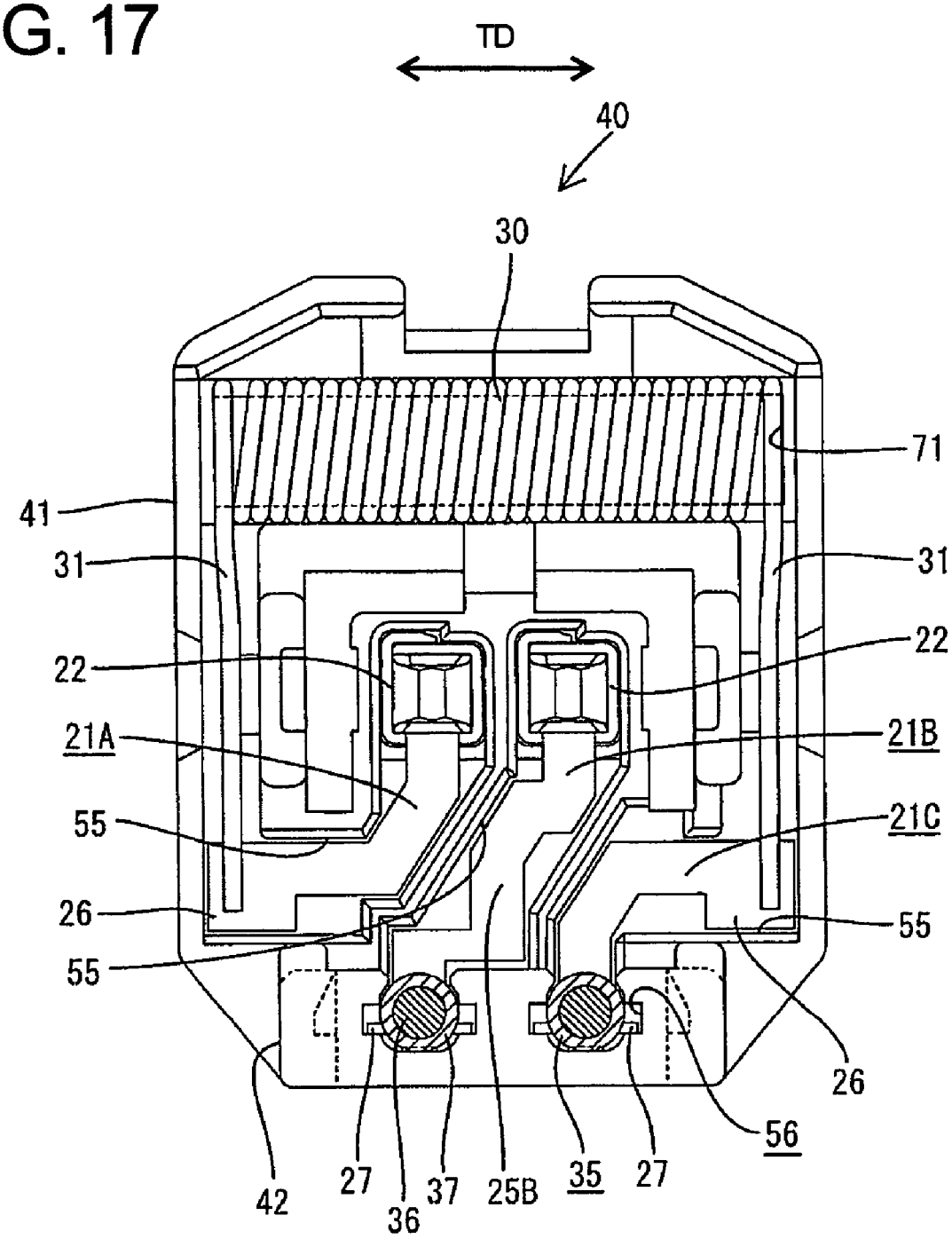
FIG. 17 is a rear view with the first cover detached.

The wire accommodating portion 42 is aligned horizontally. Thus, two side-by-side accommodating grooves 56 extend in forward and backward directions along the upper surface of the wire accommodating portion 42, as shown in FIG. 4. A first of the accommodating grooves 56 accommodates a bent part of the lead 25B of the second terminal fitting 21B and the wire 35 connected therewith. A second of the wire accommodating grooves 56 accommodates a bent part of the third terminal fitting 21C and the wire 35 connected therewith. Lower parts of the accommodating grooves 56 are slightly wider than the wire welding portions 27 and open in the rear end surface of the wire accommodating portion 42. However, the upper openings of the accommodating grooves 56 in the upper surface of the wire accommodating portion 42 are narrower for a retaining purpose, as shown in FIG. 17.

A substantially flat portion 56A is formed at the front end of the bottom of each accommodating groove 56 for receiving the wire welding portion 27 and a portion before it. An arcuate portion 56B is formed at the rear end of each accommodating groove 56 for receiving an end of an insulation coating 37 of the wire 35. Biting projections 57 are formed on the arcuate portion 56B and spaced apart along longitudinal direction.

The first cover 70 is mounted on the rear surface of the terminal accommodating portion 41 of the housing 40 and covers substantially the entire rear surface of the terminal accommodating portion 41. The second cover 90 is mounted on and the upper surface of the wire accommodating portion 42 of the housing 40. Both covers 70, 90 are made of a synthetic resin, such as PBT.

Figure 7:
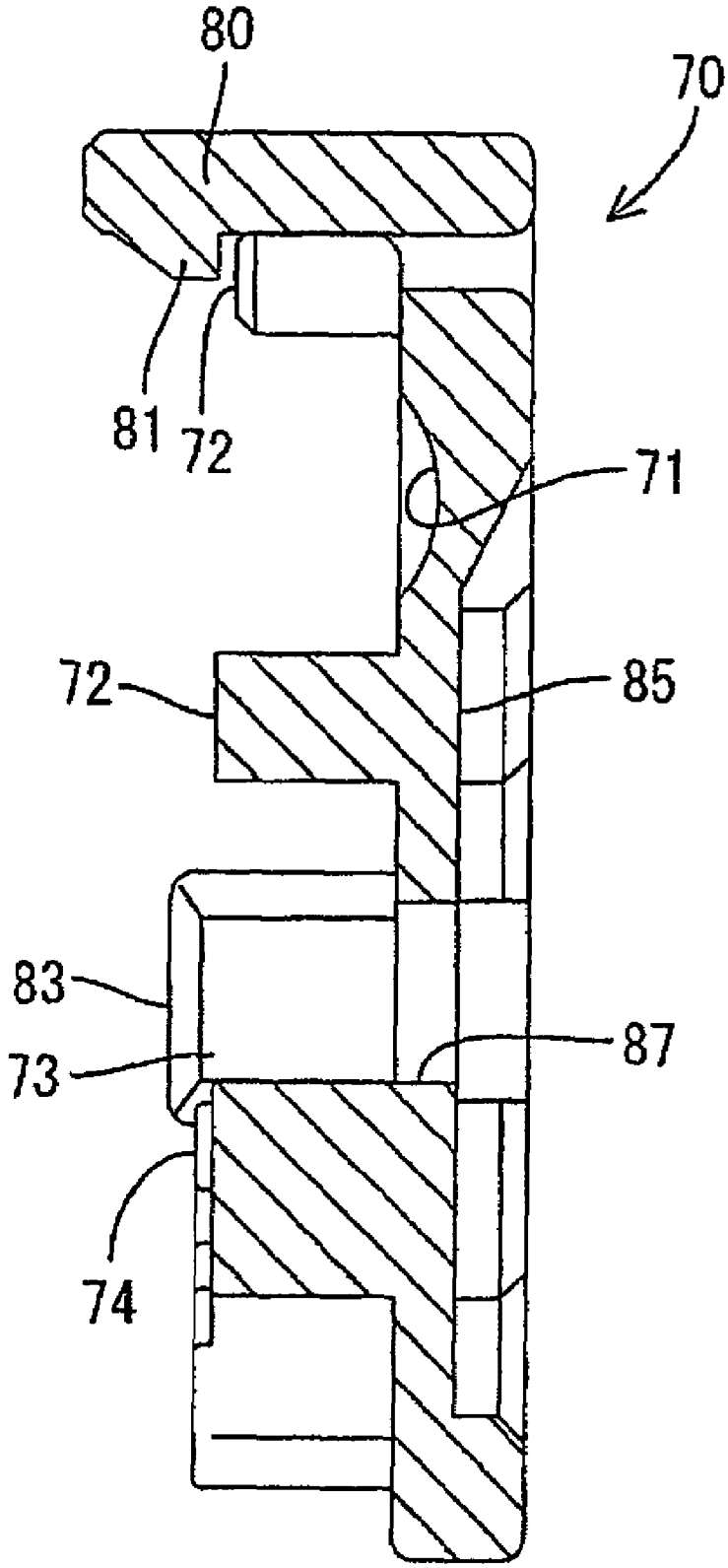
FIG. 7 is a vertical section of the first cover.

The wires 35, the first to third terminal fittings 21A to 21C and the coil 30 are arranged in a specified manner for connection into an assembly and are connected electrically by welding or soldering. This assembling operation is performed using the first cover 70. More particularly, a holding recess 71 for the coil 30 is formed at a position along the upper edge of the inner surface of the first cover 70, and positioning portions 72 project at opposite upper and/or lower sides of the holding recess 71 for holding the coil 30, as shown in FIGS. 5 and 7. Three placing portions 73 are raised in a lower area of the inner surface of the first cover 70 in a widthwise middle portion and receive parts of the leads 25A, 25B of the first and second terminal fittings 21A, 21B and a specified part of the third terminal fitting 21C. Positioning projections 74 are formed at the opposite sides of the front faces of the respective placing portions 73 for positioning and holding the placed parts.

A window 76 is formed at the opposite left and right sides and left and right sections of the upper side of an area where the placing portions 73 are formed, i.e. at a position substantially corresponding to the insertion path 49 of the housing 11. The window 76 permits insertion of the detector 100. The left and right parts of the window 76 are wider than the corresponding parts of the insertion path 49 in outward directions. Further, welding openings 77 are formed at the bottom ends of the left and right parts of the window 76 and communicate with the window 76 at obliquely outward positions.

Figure 8:
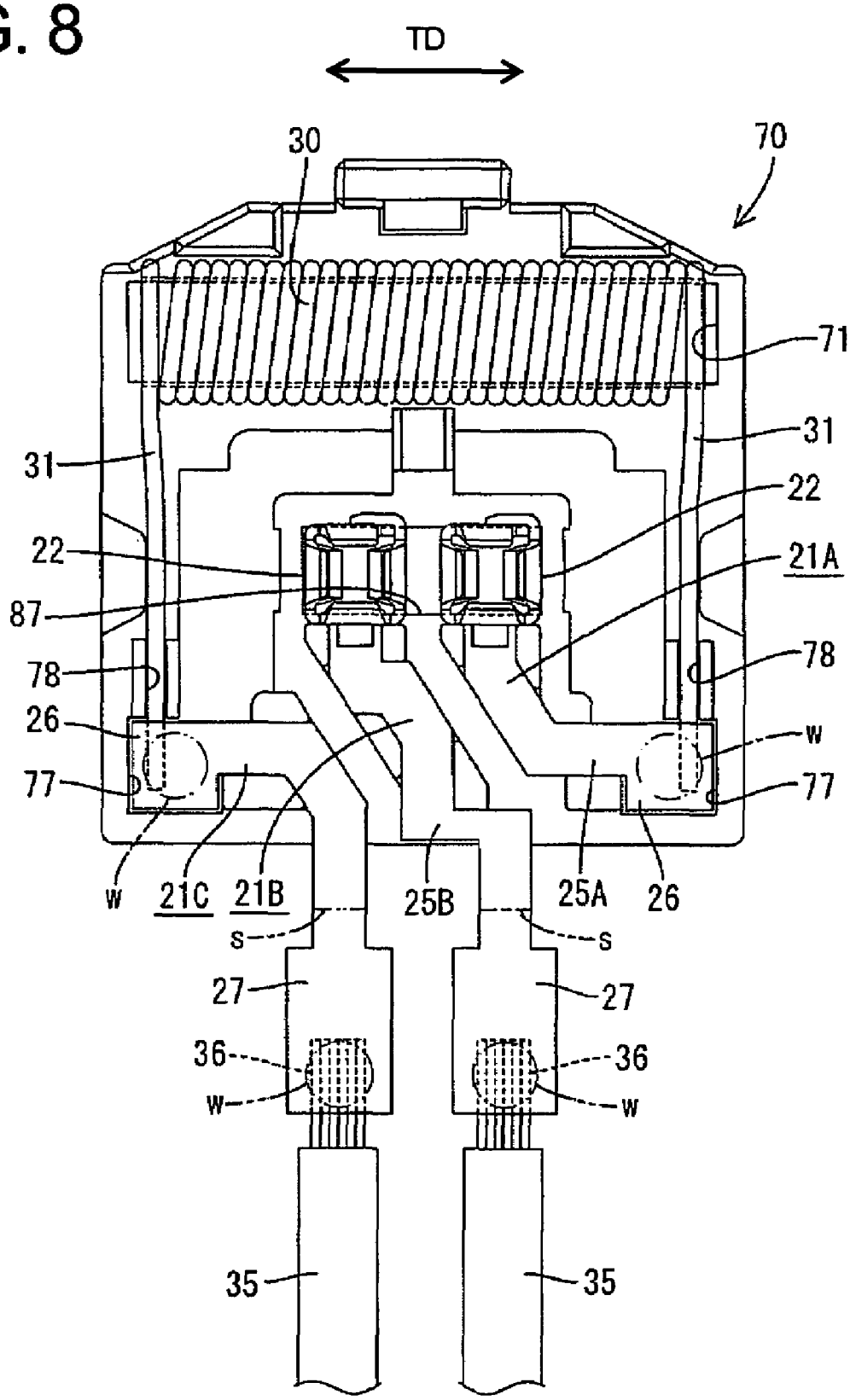
FIG. 8 is a rear view of the first cover with an assembly mounted therein after the completion of welding.

The connector is assembled by first setting the first cover 70 on a placing table of an automatic welding machine (not shown). The coil 30 then is placed in the holding recess 71, as shown in FIG. 8, and the lead wires 31 of the coil 30 are laid along the left and right edges of the first cover 70 so that the leading ends of the lead wires 31 reach the corresponding welding openings 77. Portions of both lead wires 31 slightly distanced from the leading ends of the lead wires 31 are fit into holding grooves 78. As a result, the leading ends of the lead wires 31 are in the welding openings 77 substantially at the same height as the front faces of the placing portions 73

The first to third terminal fittings 21A to 21C then are placed on the placing portions 73. More particularly, the coil welding portion 26 of the lead 25A of the first terminal fitting 21A is in one welding opening 77 and is placed on the leading end of one lead wire 31 of the coil 30. The coil welding portion 26 of the third terminal fitting 21C is located in the other welding opening 77 and is placed on the leading end of the other lead wire 31 of the coil 30. Simultaneously, the wire welding portion 27 of the lead 25B of the second terminal fitting 21B and the wire welding portion 27 of the third terminal fitting 21C project down substantially side-by-side from the first cover 70 while being spaced apart.

Ends of the cores 36 of the wires 35 are brought into contact with the rear surfaces of the corresponding wire welding portions 27. Four superimposed portions are connected by spot welds w so that the ends of the two wires 35, the first to third terminal fittings 21A to 21C and the coil 30 are connected in a specified manner. Finally, as shown in chain line in FIG. 8, the second terminal fitting 21B is bent at a right angle along the bending line "s" at a position on the lead 25B above the wire welding portion 27 and the third terminal fitting 21C is bent at a right angle along the bending line "s" at a position above the wire welding portion 27 to form an assembly A (see FIG. 1).

A resiliently deformable upper lock 80 projects forward from the upper edge of the first cover 70, and a slot 58 for receiving the upper lock 80 is formed in the upper surface of the housing 40, as shown in FIG. 3. An engaging projection 59 is formed at the bottom of the slot 58 and is engageable with a hook 81 on the upper locking piece 80.

Figure 20A:
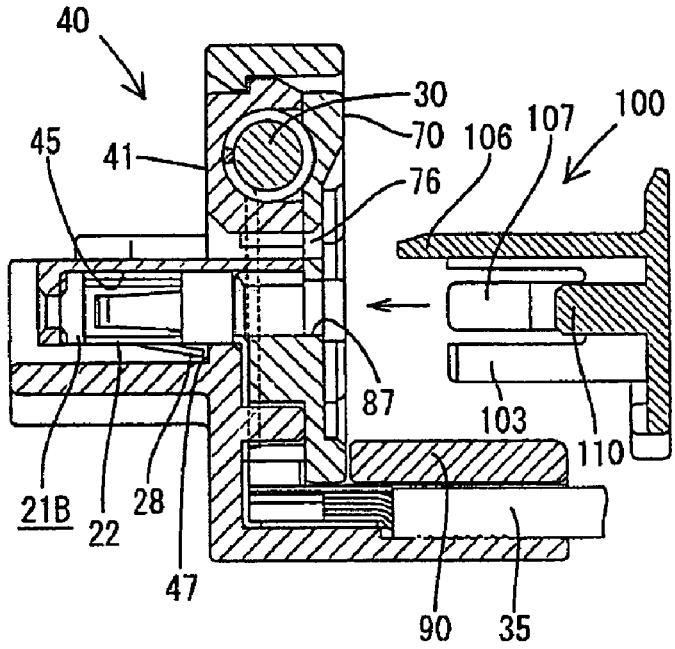
FIGS. 20(A) and 20(B) are a vertical section and a horizontal section showing a state before the detector is mounted into the connector.
Figure 20B:
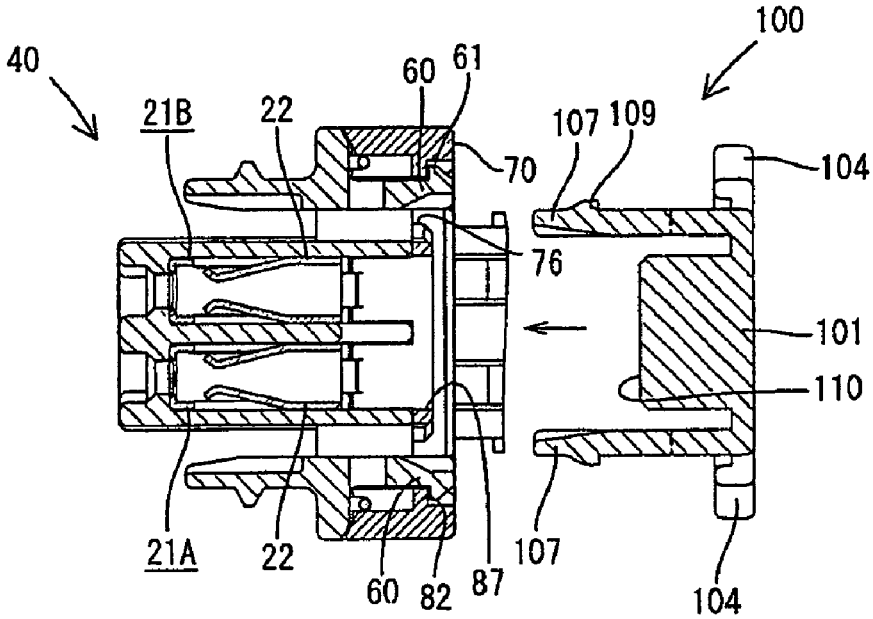

Two cover locking pieces 60 project from the rear surface of the terminal accommodating portion 41 of the housing 40 at positions behind the housing locking pieces 50, as shown in FIG. 4. The leading ends of the cover locking pieces 60 are resiliently deformable in towards the insertion path 49, and hook-shaped lock projections 61 are formed on the outer surfaces of the leading ends of the cover locking pieces 60. On the other hand, locking grooves 82 are formed in the outer edges of the left and right parts of the window 76 in the first cover 70, as shown in FIGS. 1 and 20, and the lock projections 61 of the cover locking pieces 60 can engage in the corresponding locking grooves 82 when the first cover 70 is mounted properly.

Guiding ribs 83 stand at the opposite left and right edges of the inner surface of the first cover 70, and guiding grooves 63 are formed in the left and right surfaces of the terminal accommodating portion 41 of the housing 40 for receiving the guiding ribs 83.

Figure 16:
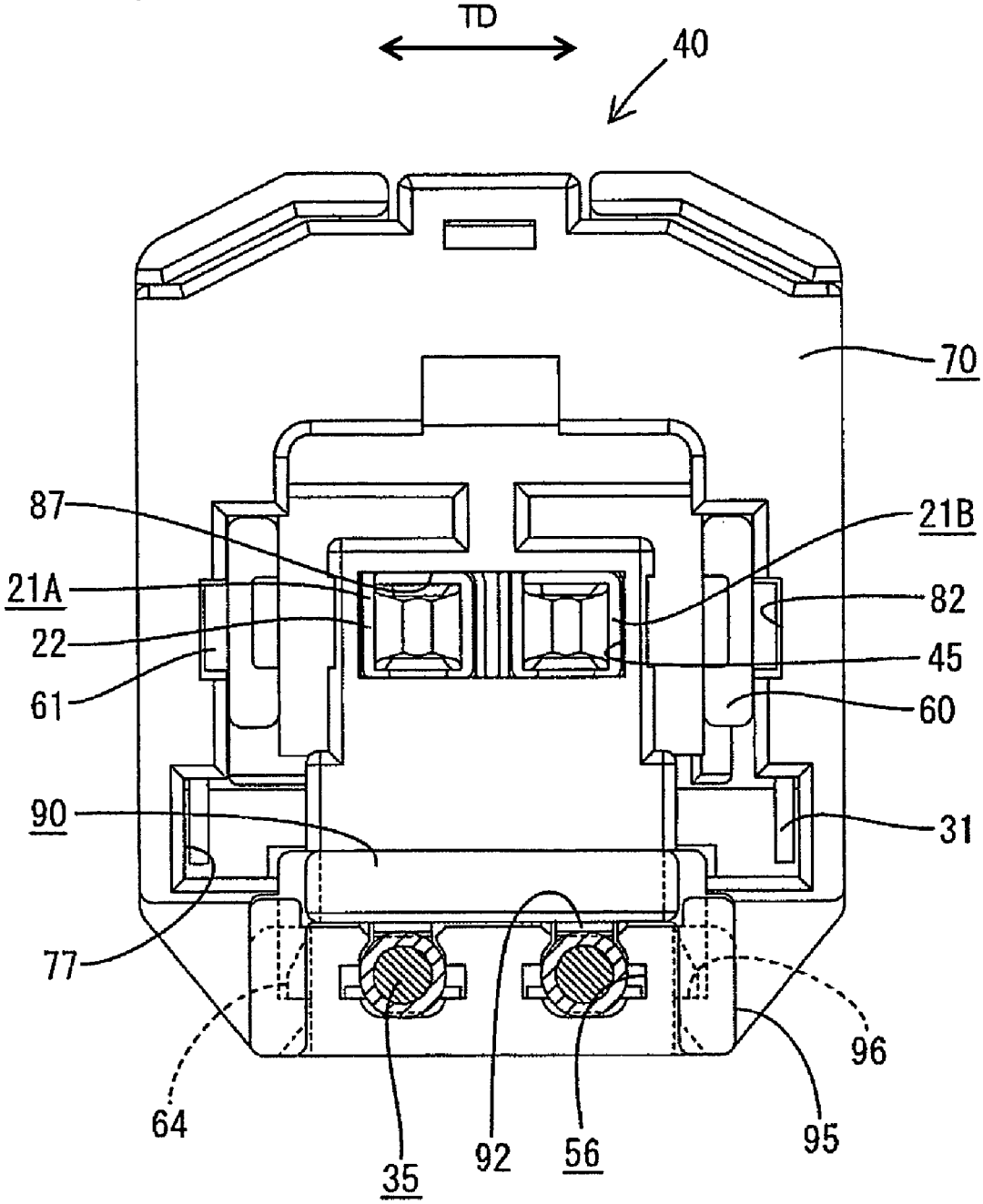
FIG. 16 is a rear view of the state of FIG. 14.

A wide rectangular opening 87 is formed through an intermediate position of the first cover 70. More specifically, the opening 87 aligns with the entrances of the two cavities 45 in the terminal accommodating portion 41, as shown in FIG. 16, if the first cover 70 is mounted properly and locked on the rear surface of the terminal accommodating portion 41.

The second cover 90 is mounted from above to cover the upper, left and right surfaces of the wire accommodating portion 42. Hence, the second cover 90 presses and holds ends of the insulation coatings 37 of the wires 35.

Figure 9:
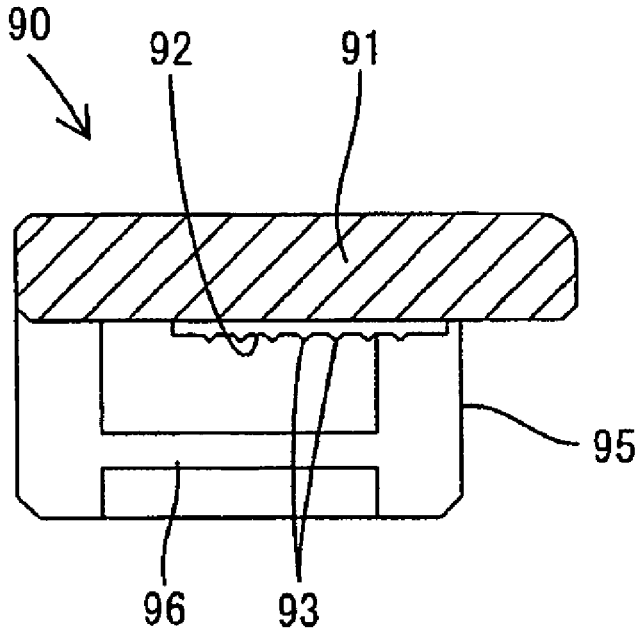
FIG. 9 is a vertical section of a second cover.
Figure 10:
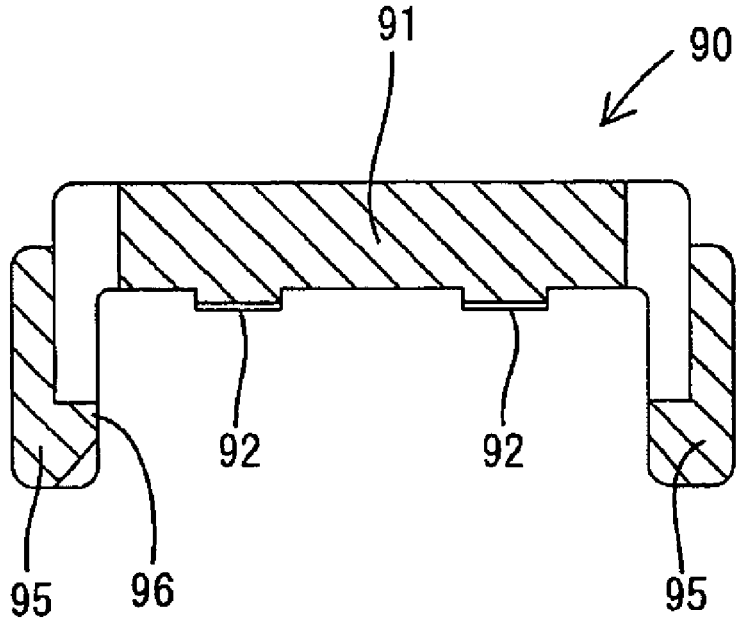
FIG. 10 is a horizontal section of the second cover.

As shown in FIGS. 9 and 10, two narrow squeezing portions 92 are formed on the lower surface of a main plate 91 of the second cover 90 and can enter the upper openings of the accommodating grooves 56 of the housing 40. Biting projections 93 are formed on the outer surfaces of the squeezing portions 92. The squeezing portions 92 squeeze and deform the ends of the insulation coatings 37 of the wires 35 in cooperation with the bottoms of the arcuate portions 56B.

Elongated locking projections 96 are formed at the projecting ends of the inner surfaces of side plates 95, and elongated engaging projections 64 are formed on the outer surfaces of the side walls of the wire accommodating portion 42 of the housing 40 for engaging the locking projections 96.

Figure 11:
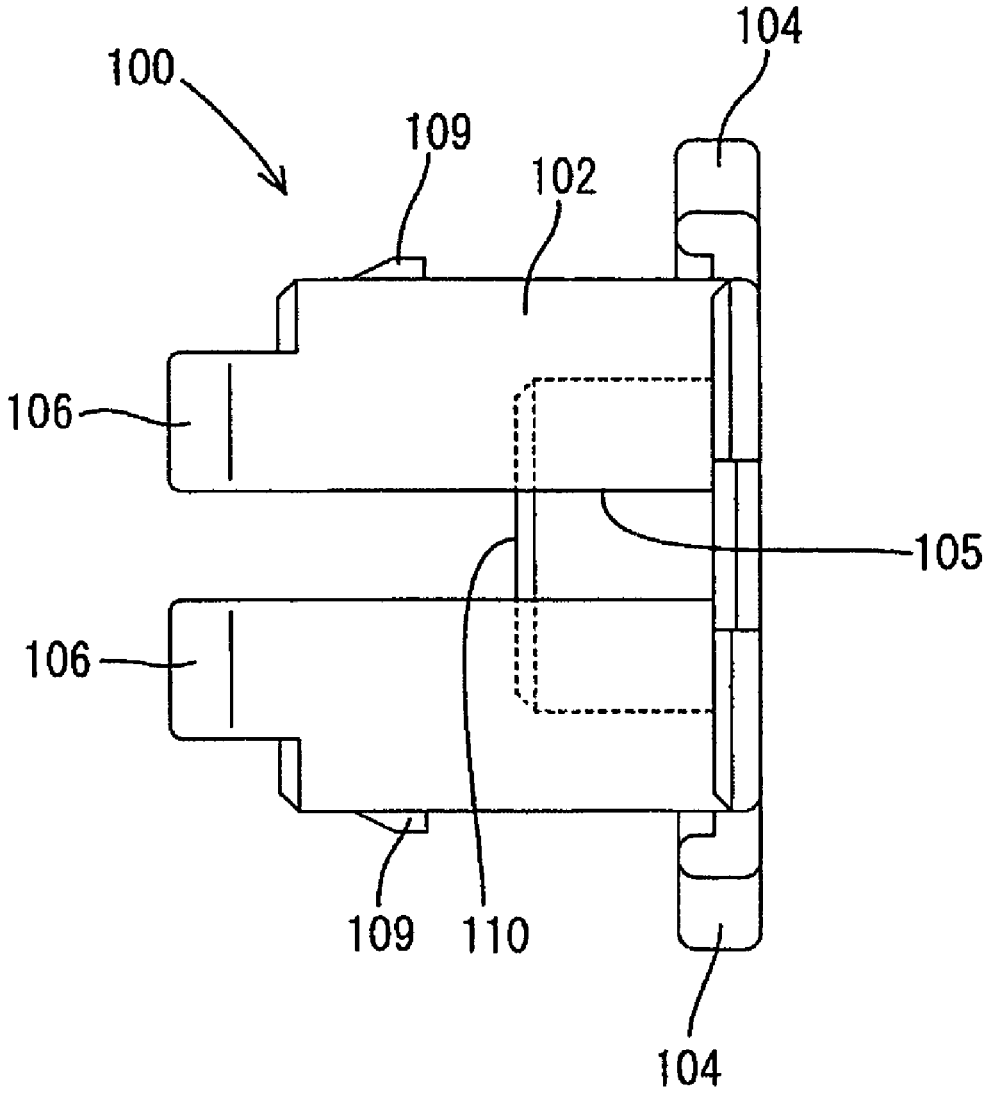
FIG. 11 is a plan view of a detector.
Figure 12:
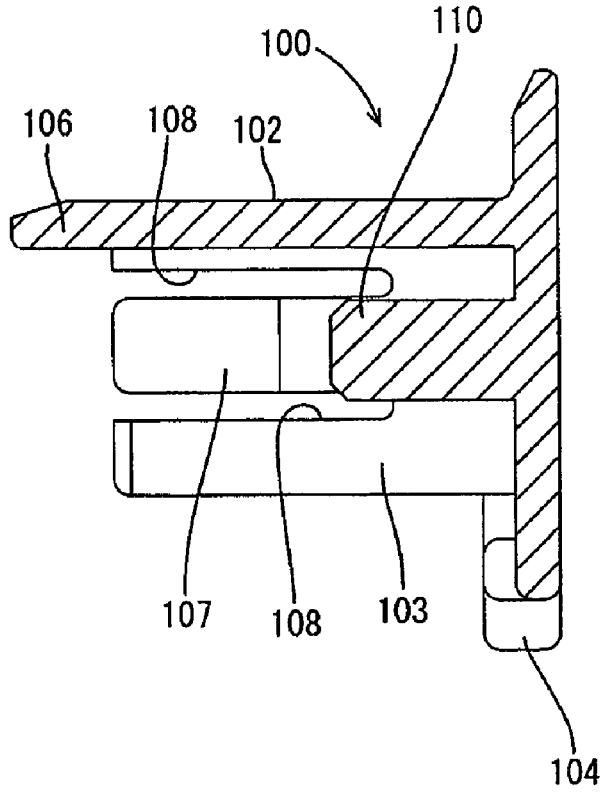
FIG. 12 is a vertical section of the detector.
Figure 13:
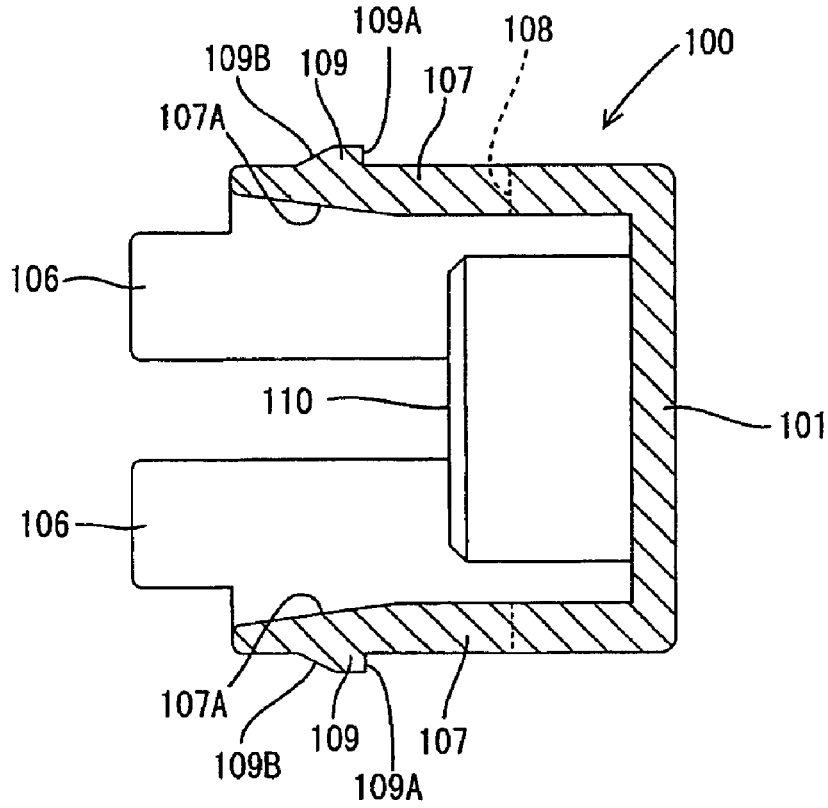
FIG. 13 is a horizontal section of the detector.

The detector 100 is made of a synthetic resin, such as PBT, and is mountable on the rear surface of the first cover 70. As shown in FIGS. 11 to 13, the detector 100 has a base plate 101 for covering the window 76 in the first cover 70. An upper wall 102 projects from the front surface of the base plate 101 and is insertable along the insertion path 49 of the housing 40 through the window 76 of the first cover 70. Left and right detecting pieces 103 project from the front surface of the base plate 101.

A mounting recess 85 is formed in the rear surface of the first cover 70 and receives the base plate 101 of the detector 100 so the base plate 101 is substantially flush with the first cover 70. Lids 104 are formed at both lower corners of the base plate 101 for closing the welding openings 77 of the first cover 70.

The upper wall 102 of the detector 100 has an escaping groove 105 is formed in a widthwise middle part of the upper wall 102 of the detector 100 to receive the closed parts at the upper sides of the window hole 76 and the insertion path 49. Two separating pieces 106 project at the opposite sides of the escaping groove 105 at the leading end of the upper wall 102. The separating pieces 106 engage the contact pieces 16 of the shorting terminal 15 and resiliently deform the contact pieces 16 towards the mounting surface 14 when the detector 100 is pushed to the full locking position MP, as described later.

Each detecting piece 103 is formed with a holding piece 107 for holding the detector 100 at a partial locking position SP and at a full locking position MP in the housing 11. The holding pieces 107 cantilever forward and are formed by slits 108. The inner surfaces of the leading sides of the holding pieces 107 are slanted to taper the holding pieces 107 towards the leading ends, so that the leading sides of the holding pieces 107 are resiliently deformable in directions towards each other. On the other hand, a holding projection 109 is formed on the outer surface of the leading side of each holding piece 107. The rear surface of the holding projection 109 is aligned upright and the front surface thereof is slanted.

Both detecting pieces 103 slide along the inner surfaces of the cover locking pieces 60 and the housing locking pieces 50 of the housing 40 (i.e. successively enter deformation spaces 60A, 50A for the locking pieces 60, 50) as the detector 100 is inserted through the window 76 of the first cover 70 and into the insertion path 49 of the housing 40.

Insertion grooves 66 are formed in the inner surfaces of the cover locking pieces 60 from the projecting ends to a position a specified distance therefrom for permitting insertion of the holding projections 109 of the holding pieces 107. Partial locking holes 67 are formed behind the insertion grooves 66 and are engageable with the holding projections 109, as shown in FIG. 4. Full locking holes 68 are formed in the inner surfaces of the base ends of the housing locking piece 50 behind the partial locking holes 67 and are engageable with the holding projections 109.

Accordingly, the holding projections 109 of the holding pieces 107 first fit into the partial locking holes 67 to hold the detector 100 temporarily at the standby position SP, as shown in FIG. 22(B). Thus, the detecting pieces 103 are in the deformation spaces 60A for the cover locking pieces 60, but stay before the deformation spaces 50A for the housing locking pieces 50 and permit deformation of the housing locking pieces 50.

Figure 25A:
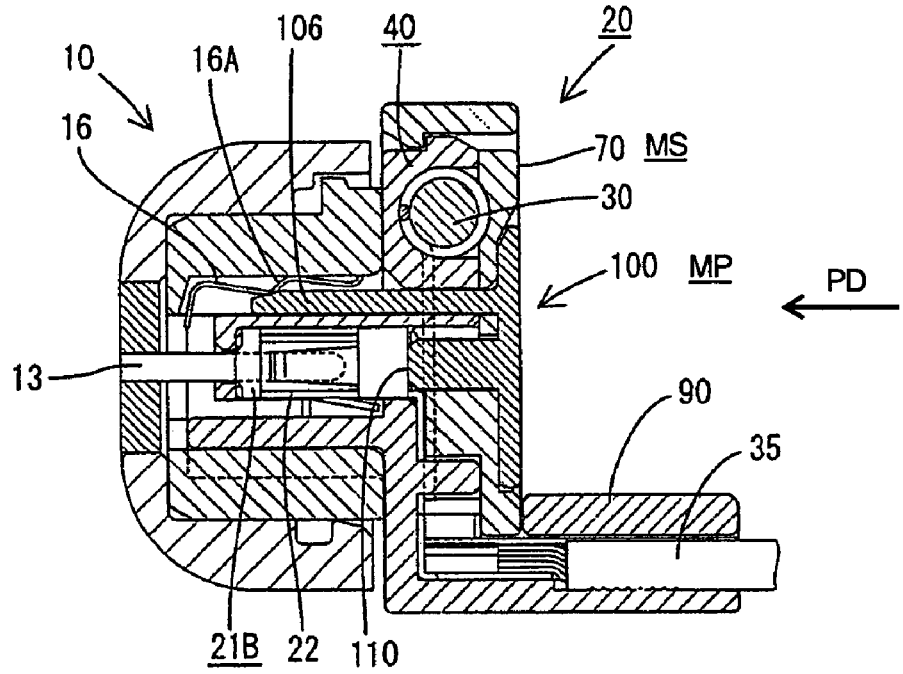
FIGS. 25(A) and 25(B) are a vertical section and a horizontal section showing a state where the detector is held at a full locking position.
Figure 25B:
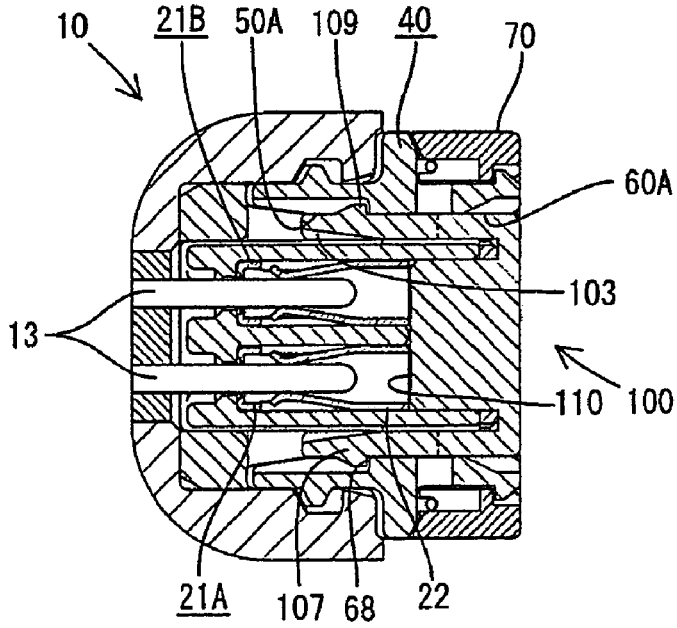

The detector 100 can be pushed farther in a pushing direction PD so that the holding projections 109 fit into the full locking holes 68 to hold the detector 100 at the mounted position MP shown in FIG. 25(B). As a result, front parts of the detecting pieces 103 are in the deformation spaces 50A for the housing locking pieces 50 and the rear parts of the detecting pieces 103 are in the deformation spaces 60A for the cover locking pieces 60. The separating pieces 106 at the upper wall 102 come to separating positions if the housing 40 is connected with the housing 11 of the mating connector 10. Thus, the separating pieces 106 are held in contact with the contact pieces 16 of the shorting terminal 15 mounted in the housing 11.

A pusher 110 projects in the center of the front surface of the detector 100 and fits closely into the opening 87 of the first cover 70. More specifically, the pusher 110 can push the rear ends of the terminal fittings 21A, 21B through the opening 87 when the detector 100 is mounted properly with the first cover 70 on the rear surface of the terminal accommodating portion 41 of the housing 40. When the detector 100 is pushed in the pushing direction PD to the full locking position MP, the pusher 110 can push the terminal fittings 21A, 21B to positions where the metal locks 28 are beyond the engaging portions 47 in the cavities 45.

The coil 30, the terminal fittings 21A-C and the wires 35 are assembled by welding, soldering or the like on the inner surface of the first cover 70, as shown in FIG. 8. The lead 25B of the second terminal fitting 21B and the third terminal fitting 21C then are bent at right angles along the bending lines "s" to let the wires 35 extend back. The terminal accommodating portion 41 of the housing 40 then is placed on the first cover 70.

Figure 14:
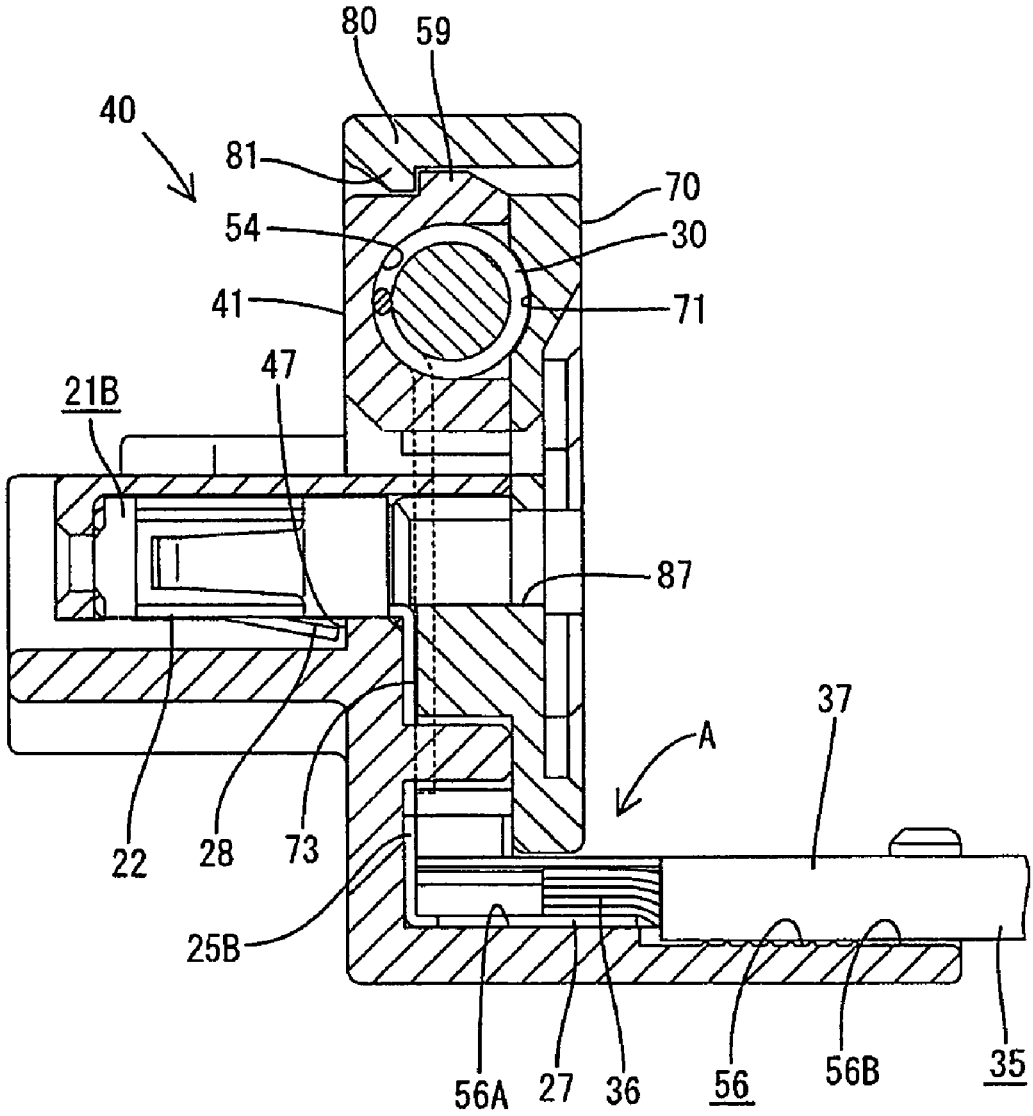
FIG. 14 is a vertical section showing a state where the first cover with the assembly is mounted in the housing.
Figure 15:
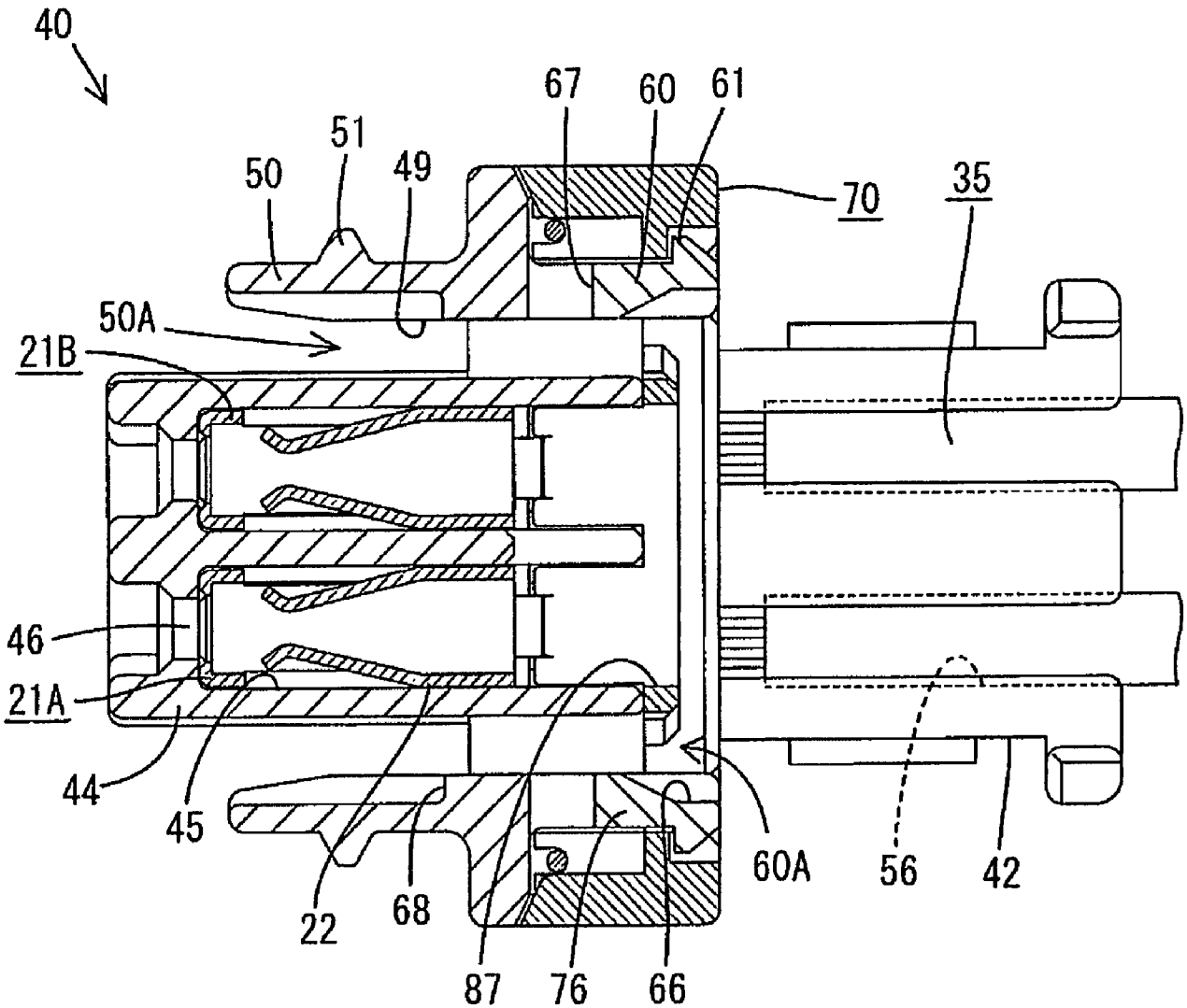
FIG. 15 is a horizontal section showing the state of FIG. 14.
Figure 18:
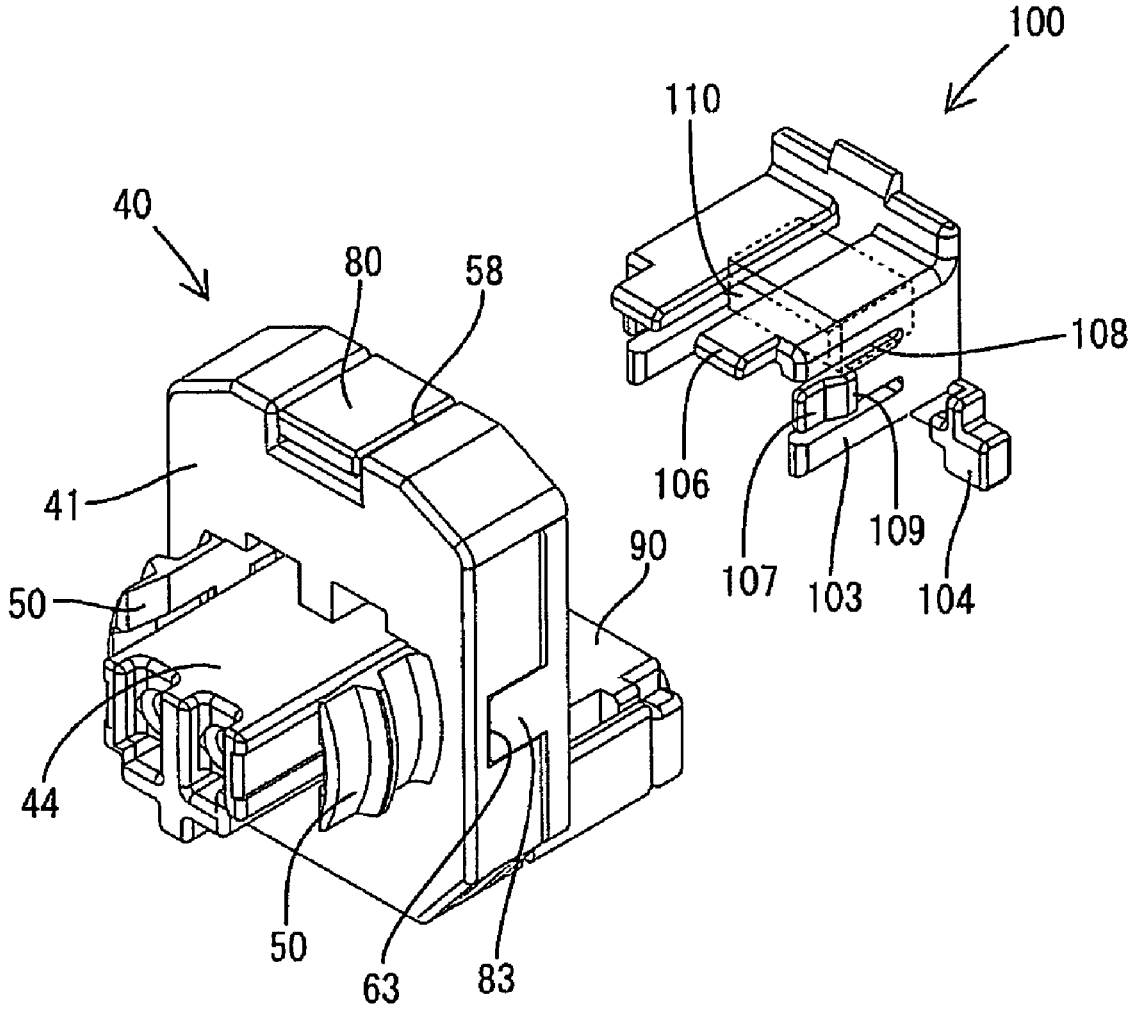
FIG. 18 is a perspective view showing a state before the detector is mounted.

To mount the first cover 70, the upper locking piece 80 is pushed into the slot 58 of the housing 40 and the left and right guiding ribs 83 are pushed into the guiding grooves 63, as shown in FIGS. 14, 15 and 18. The upper locking piece 80 moves onto the locking projection 59 and deforms resiliently at an intermediate stage of mounting. The lock projections 61 contact the outer edges of the left and right parts of the window 76 from behind. Thus, the two cover locking pieces 60 of the housing 40 deform resiliently in. The female connecting portions 22 of the first and second terminal fittings 21A, 21B then are inserted gradually into the corresponding cavities 45.

Simultaneously, the lead 25B of the second terminal fitting 21B, the bent portion of the third terminal fitting C, the wire welding portions 27 of the second and third terminal fittings 21B, 21C and the wires 35 connected therewith are inserted forward into the corresponding accommodating grooves 56 in the wire accommodating portion 42 of the housing 40 through the openings at the rear end.

The hook 81 moves over the engaging projection 59 when the first cover 70 is mounted properly. Thus, the upper locking piece 80 restores resiliently to engage the hook 81. The engaging projection 59 and the cover locking pieces 60 also restore resiliently while the lock projections 61 move over the outer edges of the window 76 and fit into the left and right locking grooves 82. As a result, the first cover 70 is locked in its mounted state MS.

In the meantime, the female connecting portions 22 of the terminal fittings 21A, 21B are inserted into the cavities 45 and are locked partly by the metal locks 28. Further, the coil 30 is accommodated and held between the coil accommodating recess 54 and the holding recess 71. Additionally, the upper sides of the leads 25A, 25B of the first and second terminal fittings 21A, 21B and the third terminal fitting 21C are accommodated in the corresponding terminal accommodating grooves 55 of the terminal accommodating portion 41 and held by the placing portions 73 of the first cover 70.

The lead 25B and the wire welding portion 27 of the second terminal fitting 21B and the bent portion and the wire welding portion 27 of the third terminal fitting 21C are placed on the flat portions 56A of the accommodating grooves 56 in the wire accommodating portion 42, and the ends of the insulation coatings of the wires 35 are placed on the arcuate portions 56B.

Further, as shown in FIG. 16, the opening 87 in the first cover 70 substantially aligns with the entrances of both cavities 45. Thus, the rear ends of the female connecting portions 22 of the terminal fittings 21A, 21B in the cavities 45 are exposed to the rear.

The second cover 90 then is mounted on the upper surface of the wire accommodating portion 42 of the housing 40. As shown in FIG. 16, the second cover 90 is pushed while the elongated locking projections 96 of the side plates 95 move onto the elongated engaging projections 64 of the housing 40 to deform the side plates 95 away from each other. The side plates 95 resiliently restore after the second cover 90 is pushed by a specified amount. Thus, the elongated locking projections 96 engage the elongated engaging projections 64 to lock the second cover 90.

The squeezing portions 92 of the second cover 90 enter the accommodating grooves 56 through the upper openings as the second cover 90 is locked. Thus, the ends of the insulation coatings 37 of the wires 35 are squeezed between the squeezing portions 92 and the arcuate portions 56B of the accommodating grooves 56 and are bitten by the biting projections 93, 57.

The second cover 90 contacts the first cover 70 and has its mounting operation hindered if the first cover 70 is not mounted properly. In such a case, the first cover 70 may be pushed into a locked position, and the second cover 90 may be mounted again.

The detector 100 is inserted from behind and along the pushing direction PD into the window 76 of the first cover 70 after both covers 70, 90 are mounted. Thus, the detector 100 is held at the standby position SP shown in FIGS. 18 and 20.

Figure 21A:
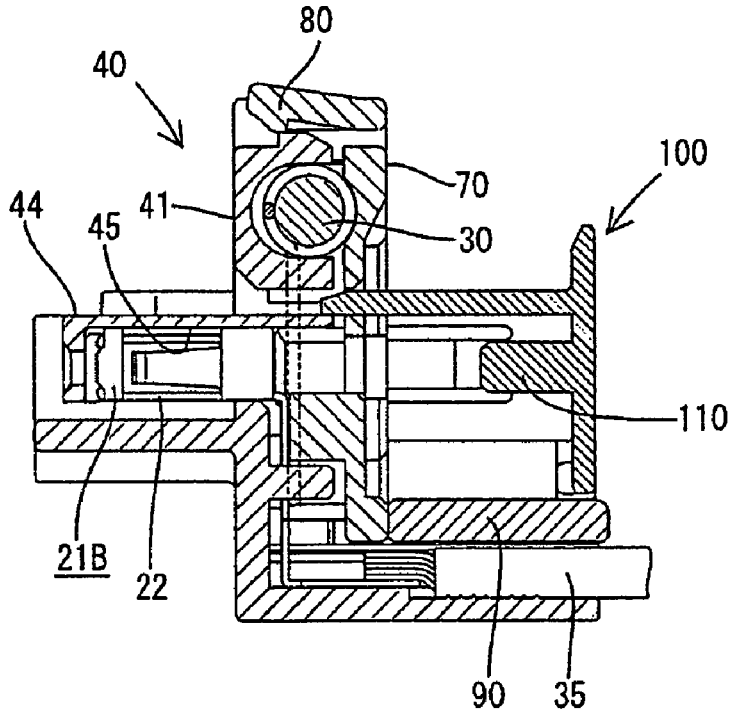
FIGS. 21(A) and 21(B) are a vertical section and a horizontal section in the case of detecting an insufficiently locked state of the first cover.
Figure 21B:
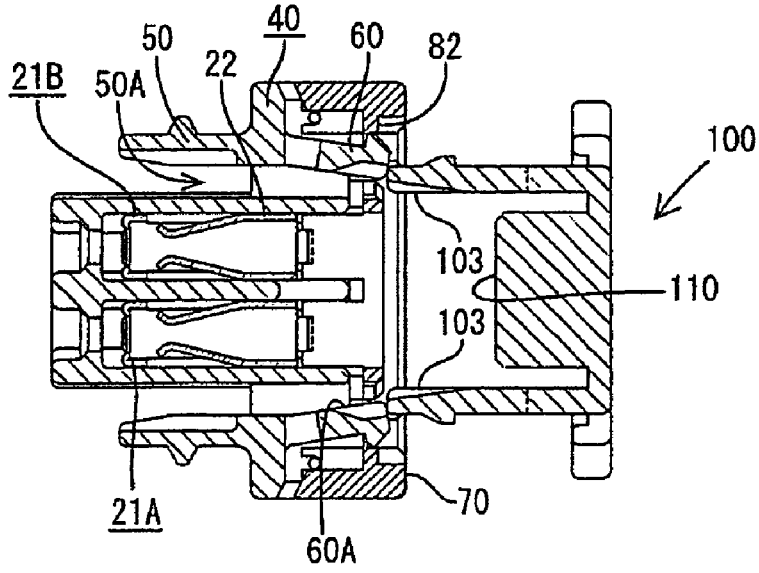

As described above, the insufficiently locked state of the first cover 70 can be detected when the second cover 90 is mounted. However, the first cover 70 may not be pushed sufficiently to be locked properly due to an assembling tolerance or the like. Thus, the cover locking pieces 60 may be left resiliently deformed towards the deformation spaces 60A, as shown in FIG. 21. Accordingly, the female connecting portions 22 of the terminal fittings 21A, 21B may not be inserted sufficiently into the cavities 45 and may not be locked by the metal locks 28. In such a case, the leading ends of the detecting pieces 103 contact the leading ends of the resiliently deformed cover locking pieces 60, as shown in FIG. 21(B). As a result, the insertion of the detector 100 is hindered, and the insufficiently locked state of the first cover 70 can be detected. The first cover 70 then may be pushed again and locked. Therefore, any female terminal fittings 21A, 21B that had been inserted insufficiently will be inserted farther so that the metal locks 28 thereof will engage properly.

The cover locking pieces 60 return towards their original postures and retract from the deformation spaces 60A when the first cover 70 is pushed sufficiently to be locked. The detector 100 then is pushed while the holding projections 109 of the holding pieces 107 pass through the insertion grooves 66 of the cover locking pieces 60. The holding pieces 107 deform resiliently inward to move over the back ends of the insertion grooves 66. However, the holding pieces 107 then restore resiliently and the holding projections 109 fit into the first locking holes 67. Thus, the detector 100 is held at the standby locking position SP shown in FIG. 22. The front sides of the detecting pieces 103 are in the deformation spaces 60A at the standby position SP, and deformation of the cover locking pieces 60 is prevented to lock the first cover 70 redundantly.

Figure 23A:
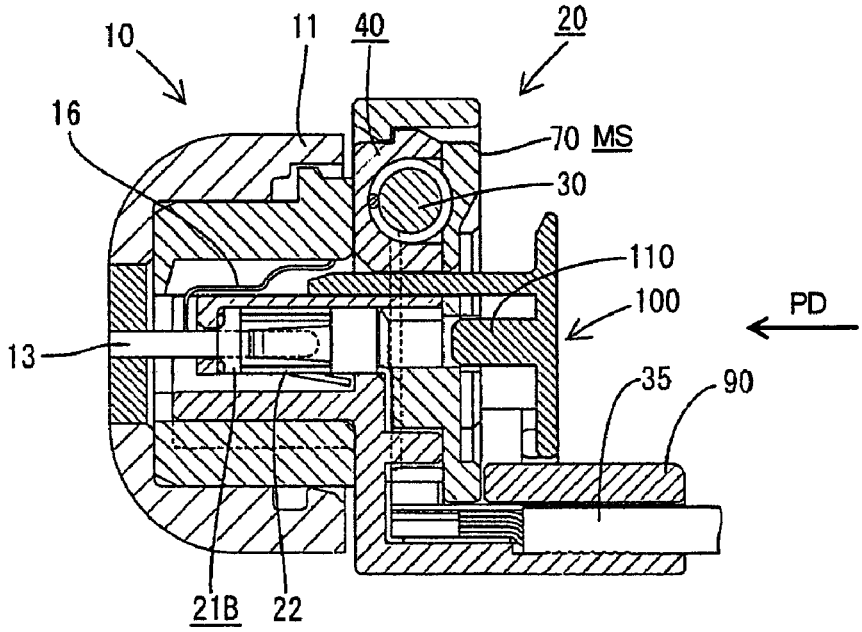
FIGS. 23(A) and 23(B) are a vertical section and a horizontal section showing the connector connected with the mating connector.
Figure 23B:
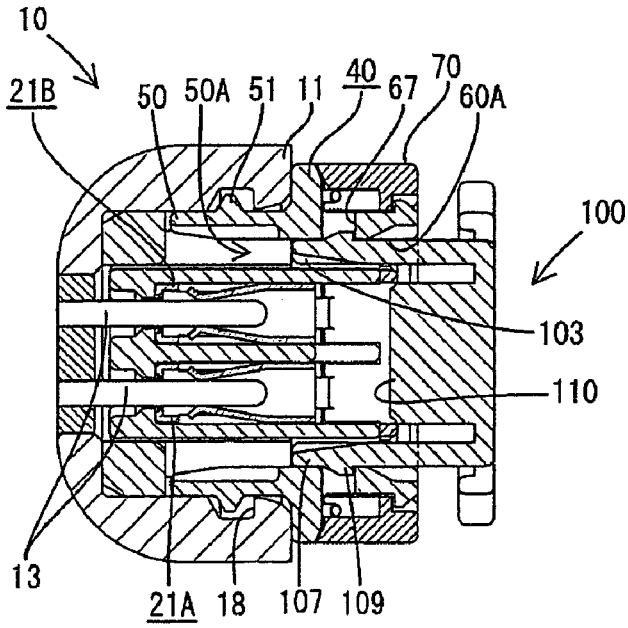

The tower 44 of the connector 20 can be fit into the guiding hole 12A of the housing 11 of the mating connector 10, as shown by arrows in FIGS. 22(A) and 22(B), while the detector 100 is at the standby position SP. The connector 20 is pushed and the housing locking pieces 50 deform resiliently inward due to the contact of the elongated locking projections 51 with the left and right edges of the housing 11. Simultaneously, the mating terminal pins 13 gradually enter the corresponding female connecting portions 22 of the first and second terminal fittings 21A, 21B. The elongated locking projections 51 fit into the locking grooves 18 of the mating housing 11 when the connector 20 is connected by a specified amount, as shown in FIG. 23. Thus, the housing locking pieces 50 restore resiliently to lock the connector 20.

The detector 100 is pushed in the pushing direction PD from the standby position SP to the mounting position MP after the connector 20 is connected with the mating connector 10 is completed.

Figure 24A:
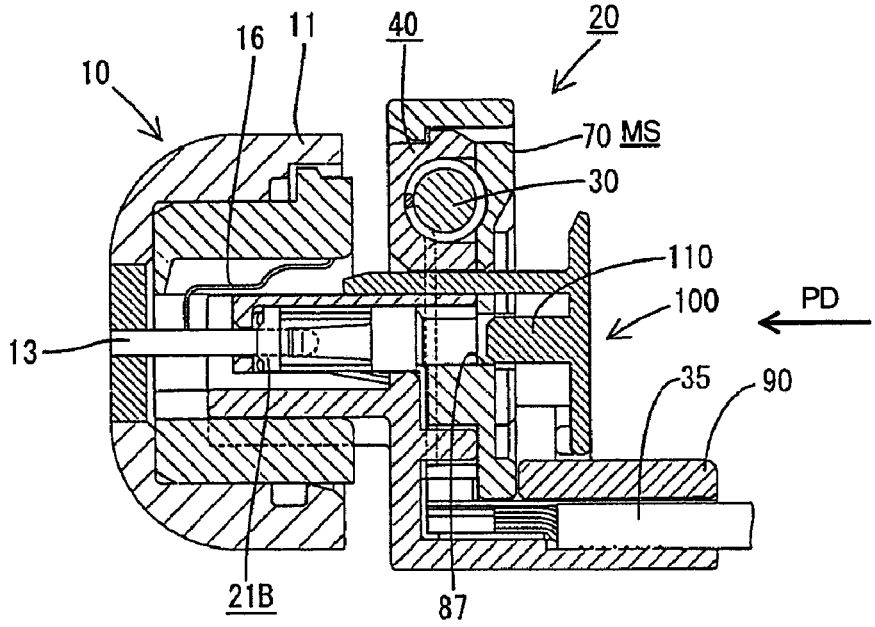
FIGS. 24(A) and 24(B) are a vertical section and a horizontal section in the case of detecting an insufficiently connected connector.
Figure 24B:
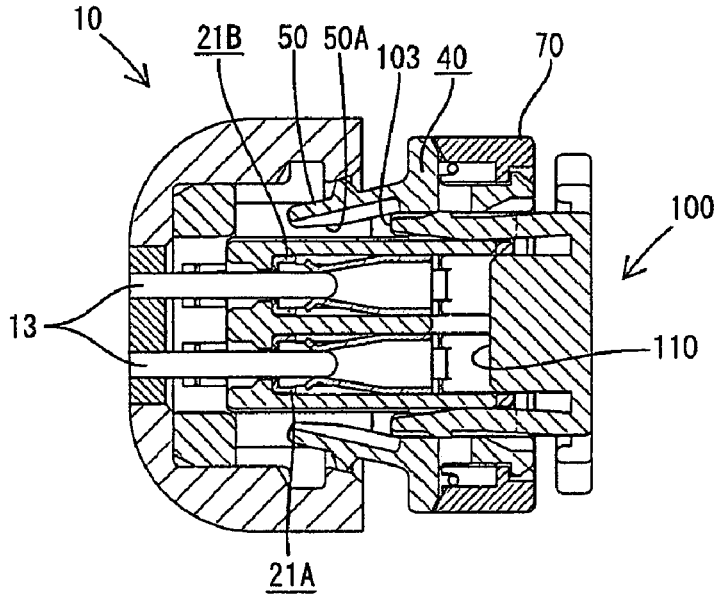

The housing locking pieces 50 will remain deformed into the deformation spaces 50A, as shown in FIG. 24(B), if the connector 20 was not pushed sufficiently, and hence the connector 20 will not be locked properly. In such a case, the leading ends of the detecting pieces 103 will contact the inner surfaces of the resiliently deformed housing locking pieces 50, as shown in FIG. 24(B), to hinder further insertion of the detector 100. In this way, the insufficiently locked state of the connector 20 can be detected and the connector 20 may be pushed again.

The housing locking pieces 50 return substantially to their original postures and retract from the deformation spaces 50A when the connector 20 is pushed sufficiently to be locked. Thus, the holding pieces 107 enter the deformation spaces 50A together with the detecting pieces 103 while being resiliently deformed. The holding pieces 107 then return resiliently so that the holding projections 109 fit into the full locking holes 68, as shown in FIG. 25. Thus, the detector 100 is held at the full locking mounted position MP.

Figure 26:
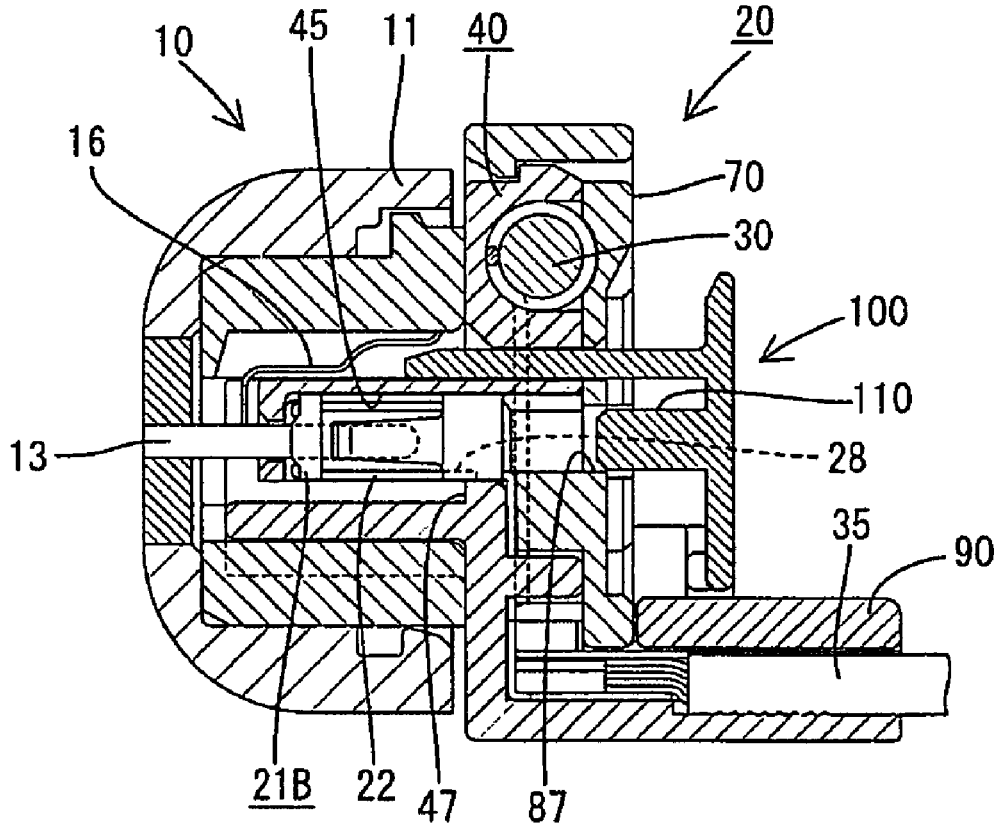
FIG. 26 is a vertical section showing a terminal fitting insufficiently inserted with the first cover properly mounted.

As shown in FIG. 26, the female connecting portions 22 of the terminal fittings 21A, 21B may not be pushed to the specified positions, for example, due to an error in production or the bending of the lead portions 24A, 24B. Accordingly, the female connecting portions 22 may be left insufficiently inserted without the metal locks 28 being engaged with the engaging portions 47 despite the fact that the first cover 70 is mounted properly. In such a case, the pusher 110 enters the first cover 70 through the opening 87 as the detector 100 is pushed to the full locking mounted position MP. Thus, the rear ends of the female connecting portions 22 are pushed to push the terminal fittings 21A, 21B further forward. In this way, the metal locks 28 pass the engaging portions 47 and deformed to engage the engaging portions 47 (see FIG. 25).

The pusher 110 is fixed immediately after the female connecting portions 22 of the terminal fittings 21A, 21B when the detector 100 is held at the full locking mounted position MP, as described above. Thus, the terminal fittings 21A, 21B are locked more securely.

The separating pieces 106 of the detector 100 push the slanted portions 16A of the contact pieces 16 of the shorting terminal 15 as the female connecting portions 22 of the first and second terminal fittings 21A, 21B and the mating terminal pins 13 connect properly. Thus, the separating pieces 106 resiliently deform the contact pieces 16 out and away from the terminal pins 13 to cancel the shorted state between the two terminal pins 13.

Front parts of the detecting pieces 103 are in the deformation spaces 50A for the housing locking pieces 50 and prevent deformation of the housing locking pieces 50. Thus, the housings 11, 40 are locked redundantly. Further, rear parts of the detecting pieces 103 remain in the deformation spaces 60A for the cover locking pieces 60 and prevent deformation of the cover locking pieces 60. Thus, the first cover 70 is kept doubly locked.

As described above, the terminal fittings 21A, 21B could be left insufficiently inserted even though the first cover 70 is mounted properly. However, the pusher 110 pushes the rear ends of the female connecting portions 22 through the opening 87 of the first cover 70 and moves the terminal fittings 21A, 21B to the proper insertion positions as the detector 100 is pushed in the pushing direction PD to the fully locked mounted position MP. Hence, the insertion of the terminal fittings 21A, 21B to the proper positions can be assured with high reliability. Further, the construction is simpler because the detector 100 also detects the connected state of the connectors 10, 20.

The detector 100 can be held at the fully locked mounted position MP and, in this state, the pusher 110 is fixed immediately after the female connecting portions 22 of the terminal fittings 21A, 21B. Therefore, the terminal fittings 21A, 21B are locked more securely.

The detector 100 detects whether the first cover 70 is mounted properly and also is a member for detecting the connected state of the connectors 10 and a member for pushing the terminal fittings 21A, 21B to the proper insertion positions. Thus, the construction of the connector is even simpler. Further, one detecting piece 103 is a detecting piece for cover and a detecting piece for housing. Thus, the construction of the detector 100 can be simpler and a mounting space for the detector 100 can be smaller.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

The housing locking pieces and the cover locking pieces may be provided at distanced positions instead of being arranged substantially one after another. In such a case, the detector may be formed with different detecting pieces that can individually enter the deformation spaces for the housing locking pieces and for the cover locking pieces.

The detector has a function of detecting whether the first cover is locked in the foregoing embodiment. However, detectors having no such function are also embraced by the technical scope of the invention.

The detector may be directly insertable to the full mounted position MP without being held temporarily at the standby position SP.

The invention applies to connectors with terminal fittings and wires in a housing, but with no other electrical components, such as a coil.

The invention applies to all cover-fitted connectors, such as those where the terminal fittings and wire draw-out directions are at right angles.

What is claimed is:

1. A connector, comprising:

a housing;

terminal fittings insertable into the housing in an inserting direction;

a cover mountable on the housing for at least partly covering a surface of the housing, the cover being formed with an opening for exposing portions of the terminal fittings in the housing when the cover is mounted properly on the housing; and a detector mountable to the cover, the detector being formed with at least one pushing portion that can push the exposed portions of the terminal fittings through the opening to push the terminal fittings towards proper insertion positions when the detector is mounted properly on the properly mounted cover.

2. The connector of claim 1, further comprising a resiliently deformable housing lock for locking the housing and a mating housing (11) in a properly connected state.

3. The connector of claim 2, wherein the detector includes a housing detecting piece for insertion into a deformation space for the housing lock.

4. The connector of claim 3, wherein the detector includes a holder resiliently engageable with the housing for holding the detector in a properly mounted position (MP) on the cover when the cover is mounted properly on the housing.

5. The connector of claim 3, wherein the housing includes a resiliently deformable cover lock for locking the cover in a mounted state on the housing.

6. The connector of claim 5, wherein the detector includes a cover detecting piece that is insertable into a deformation space for the cover lock as the detector is mounted.

7. The connector of claim 6, wherein the deformation space for the cover locking piece and the deformation space for the housing locking piece are formed on a common path and communicate with each other.

8. The connector of claim 7, wherein the detector includes a detecting piece that is insertable into both the deformation space for the cover locking piece and the deformation space for the housing locking piece, whereby the detecting piece serves both as the detecting piece for cover and as the detecting piece for housing.

9. A connector, comprising:

a housing having opposite front and rear ends and cavities extending through the housing substantially from the rear end to the front end;

terminal fittings insertable into the cavities from the rear end of the housing;

a cover mountable on the rear end of the housing for at least partly covering the rear end of the housing, the cover being formed with an opening for exposing portions of the terminal fittings in the cavities when the cover is mounted properly on the housing; and a detector mountable to the cover, the detector having at least one pusher insertable through the opening for pushing the terminal fittings towards proper insertion positions when the detector is mounted properly and when the cover is mounted properly.

10. The connector of claim 9, wherein the detector includes a holder resiliently engageable with the housing for holding the detector in a properly mounted position on the cover when the cover is mounted properly on the housing.

11. The connector of claim 10, wherein the housing includes a resiliently deformable cover lock for locking the cover in a mounted state on the housing.

12. The connector of claim 11, wherein the detector includes a cover detecting piece that is insertable into a deformation space for the cover lock as the detector is mounted for detecting whether the cover is mounted properly on the housing.

13. The connector of claim 12, further comprising a resiliently deformable housing lock for locking the housing and a mating housing in a properly connected state, the detector including a housing detecting piece for insertion into a deformation space for the housing lock.

14. The connector of claim 13, wherein the deformation space for the cover locking piece and the deformation space for the housing locking piece are formed on a common path and communicate with each other, and wherein the detector includes a detecting piece that is insertable into both deformation spaces for simultaneously detecting whether the cover is mounted properly on the housing and whether the housing is connected properly with the mating housing.

* * * * *